US009287662B2

(12) United States Patent
Suzuki

(10) Patent No.: US 9,287,662 B2
(45) **Date of Patent: *Mar. 15, 2016**

(54) CONNECTOR WITH FORCE MULTIPLYING MECHANISM

(71) Applicant: Sumitomo Wiring Systems, Ltd., Yokkaichi, Mie (JP)

(72) Inventor: Masakazu Suzuki, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 32 days.

This patent is subject to a terminal disclaimer.

(21) Appl. No.: 14/190,225

(22) Filed: Feb. 26, 2014

(65) Prior Publication Data

US 2014/0242821 A1 Aug. 28, 2014

(30) Foreign Application Priority Data

Feb. 26, 2013 (JP) ..... 2013-035254

(51) Int. Cl.
*H01R 13/629* (2006.01)
*H01R 27/02* (2006.01)

(52) U.S. Cl.
CPC ..... *H01R 13/62922* (2013.01); *H01R 27/02* (2013.01)

(58) Field of Classification Search
CPC ..... H01R 13/629; H01R 13/5208
USPC ..... 439/587, 157, 629
See application file for complete search history.

(56) References Cited

U.S. PATENT DOCUMENTS 6,071,146 A * 6/2000 Horner ..... 439/587
7,114,991 B2 * 10/2006 Shiga et al. ..... 439/587
2011/0312198 A1 * 12/2011 Komiyama et al. ..... 439/157

FOREIGN PATENT DOCUMENTS

JP 2011-216441 10/2011

* cited by examiner

*Primary Examiner* — Tulsidas C Patel
*Assistant Examiner* — Marcus Harcum
(74) *Attorney, Agent, or Firm* — Gerald E. Hespos; Michael J. Porco; Matthew T. Hespos

(57) ABSTRACT

A connector with a force multiplying mechanism includes first and second fixed connectors (F1, F2) which are arranged side by side and each of which includes cam followers (17, 18), and first and second lever connectors (L1, L2) which are individually connectable to the respective fixed connectors (F1, F2) and each of which includes a rotatably provided lever (20, 70) and is connectable to the corresponding one of the fixed connectors (F1, F2) by a force multiplying action produced by rotating the lever (20, 70) while the cam followers (17, 18) and the lever (20, 70) are engaged directly or indirectly via a slider (19). The first and second fixed connectors (F1, F2) are so arranged that surfaces where the cam followers (17, 18) are formed are perpendicular to each other.

14 Claims, 36 Drawing Sheets

CONNECTOR WITH FORCE MULTIPLYING MECHANISM

BACKGROUND

1. Field of the Invention

The invention relates to a connector with a force multiplying mechanism.

2. Description of the Related Art

A lever-type connector utilizes a lever that can be rotated to multiply forces for connecting connectors. A force multiplying effect of a single lever may not be sufficient if the connector has a large number of poles. As a countermeasure, Japanese Unexamined Patent Publication No. 2011-216441 considers dividing each connector into a plurality of parts, arranging the divided parts adjacent to each other and providing another force multiplying mechanism. More particularly, two male connectors with cam followers are arranged adjacent to each other on the same wall and levers are provided separately on two female connectors to be connected to the male connectors. The male connectors should be arranged at a narrow interval. However, the surfaces of the male connectors that have the cam followers face the same direction. Thus, the connectors must be set in a complicated manner in a plan view when the connectors are connected so that the shapes and arrangements of the levers are point symmetrical with respect to a point between the connectors and centered on a central part where operating portions are in contact.

The invention aims to provide a connector with a force multiplying mechanism and substantially side by side connectors arranged as close as possible.

SUMMARY OF THE INVENTION

The invention relates to a connector assembly with a force multiplying mechanism. The connector assembly has fixed connectors arranged substantially side by side on the same plane. Each fixed connector includes a cam follower. The connector assembly also has lever connectors that are connectable individually to the respective fixed connectors. Each lever connector includes a displaceable lever and is connectable to the corresponding fixed connector by a force multiplying action produced by displacing the lever in a state where the cam follower and the lever are engaged directly or indirectly. The cam followers of two adjacent fixed connectors are on surfaces that are at an angle and preferably substantially perpendicular to each other.

A slider is accommodated in at least one of the lever connectors and is movable along an arrangement direction of the fixed connectors. The slider includes a cam groove that engages the cam follower to produce the force multiplying action as the lever is displaced.

The slider is movable between a start position where the cam follower is received in the cam groove and an end position where the fixed connector is connected completely to the lever connector. The slider projects out from the lever connector in the arrangement direction when at the start position. The projection of the slider from the lever connector at the start position does not cause interference with the adjacent lever-side connector or fixed connector. Therefore, there is no problem in narrowing a distance between the adjacent connectors.

Wire drawing directions of adjacent lever connectors may be substantially opposite outward directions with respect to the arrangement direction. Accordingly, wires drawn out from the adjacent lever connectors do not interfere with each other.

The lever-side connector may comprise a housing connectable to the fixed-side connector and the lever may be mounted displaceably to opposite side surfaces of the housing. A wire cover projects out from the housing and covers a wire drawing surface. The wire cover is configured to correct a wiring direction of wires drawn out from the wire drawing surface. The lever is mounted to the side surfaces of the housing between the connection surface and the wire drawing surface and is displaceable substantially along the connecting direction between the connection surface and the wire drawing surface.

The wire cover preferably includes a base that is mountable on the housing and that is open toward the wire drawing surface. A correcting portion rises from the peripheral edge of the base via a constricted portion to narrow an inner space from the base. Accordingly, the wires drawn out from the wire drawing surface can be drawn out from the wire cover while being collected in a projecting end space in the wire cover. Thus, taping can be performed easily on a wire drawing part of the wire cover.

The correcting portion of the wire cover extends and projects from the base in a direction substantially parallel to a rotation axis of the lever via the constricted portion. The lever has two lever plates to be mounted on the housing and an operating portion that couples ends of the lever plates. The lever is held at an initial position before connection to the mating connector. The operating portion of the lever is located along an extending direction of the constricted portion near the constricted portion at the initial position. According to this configuration, the lever will not interfere with the wire cover.

At least one connector preferably has a one-piece resilient plug formed with wire insertion holes and configured to collectively seal wires drawn out from the rear end surface of a housing by inserting the wires into the corresponding wire insertion holes. The connector has two wall surfaces for sandwiching the one-piece resilient plug from the front and rear substantially in an inserting direction of the wires. At least one positioning pin projects substantially parallel to axial directions of the wire insertion holes from one of the wall surfaces toward the one-piece resilient plug and is press-fit into at least one positioning hole near the wire insertion holes. At least one narrowed portion may be formed at an axial intermediate position of the positioning hole and has a small diameter.

At least one inner lip is formed on the inner peripheral surface of each wire insertion hole for closely contacting an insulation coating of the wire. The narrowed portion in the positioning hole is at an axial position corresponding to the axial position of the tops of the inner lips. This configuration enhances sealing with the wire insulation coatings.

Plural positioning holes preferably are arranged at diagonally symmetric positions with respect to the wire insertion hole. This configuration contributes to making sealing forces for the wires circumferentially uniform while narrowing intervals between the respective wire insertion holes as much as possible.

The slider preferably is movable with respect to the housing between a start position where the cam follower is received into the cam groove in a state where the slider projects back in a mounting direction thereof and an end position reached by inserting the slider deeper into the housing from the start position to properly connect the connector with the mating connector. At least one of the slider and the lever includes a lock that engages the housing to hold the slider at the start position. However, the lock is released from the housing by displacing the lever. The lever has a protecting edge at substantially the same height as a projecting end of the slider from the housing when the slider is at the start position and at substantially the same position as or behind the projecting end part of the slider in the mounting direction of the slider to prevent inadvertent contact with the slider.

The lever preferably is mounted rotatably on the housing via at least one rotary shaft. A distance from the rotary shaft to the protecting edge preferably is shorter than a distance from the rotary shaft to the operating portion.

The lever preferably comprises two lever plates and the operating portion couples the lever plates. The lever is mounted to straddle between opposite side surfaces of the housing adjacent to a surface through which the slider is mounted. The protecting edge is formed on each of the lever plates to sandwich the projecting end of the slider. The disposition of the protecting edges on both sides of the projecting end part of the slider prevents interference of external matter with the projecting end part of the slider.

Conventionally, a lever is mounted on a connector housing to straddle a wire cover. Thus, the lever must have a length sufficient to straddle the wire cover. However, the lever of the invention is provided in a space different from a space where the wire cover projects. Thus, the length of the lever can be set independently of the projecting height of the wire cover, and the lever can be miniaturized.

The one-piece resilient plug is mounted to the housing by press-fitting the positioning pin into the positioning hole. On the other hand, material around the positioning hole is pushed strongly out at the narrowed portion in the positioning hole and narrows the wire insertion holes arranged near the positioning hole for enhancing press-contact forces and sealing applied to insulation coatings of the wires in the wire insertion holes.

The slider projects out from the housing at the start position. External matter may contact the projecting end and may exert an external force in a pushing direction. Thus, the lock may be released from the locking state and the slider may move toward the end position. However, according to the invention, the projecting edge of the lever is at substantially the same position as or behind the projecting end part when the slider is at the initial position. Thus, a pushing force by the external matter acts first on the protecting edge instead of on the slider. Specifically, the distance from the rotary shaft to the protecting edge of the lever is shorter than the distance to the operating portion. Thus, a force necessary to release the lock is larger when the force acts on the protecting edge than when it directly acts on the projecting end of the slider. Thus, the invention can alleviate a situation where the slider is pushed inadvertently to the end position.

These and other features of the invention will become more apparent upon reading the following detailed description and accompanying drawings. It should be understood that even though embodiments are described separately, single features thereof may be combined to additional embodiments.

DETAILED DESCRIPTION OF THE PREFERRED EMBODIMENTS

Figure 36:
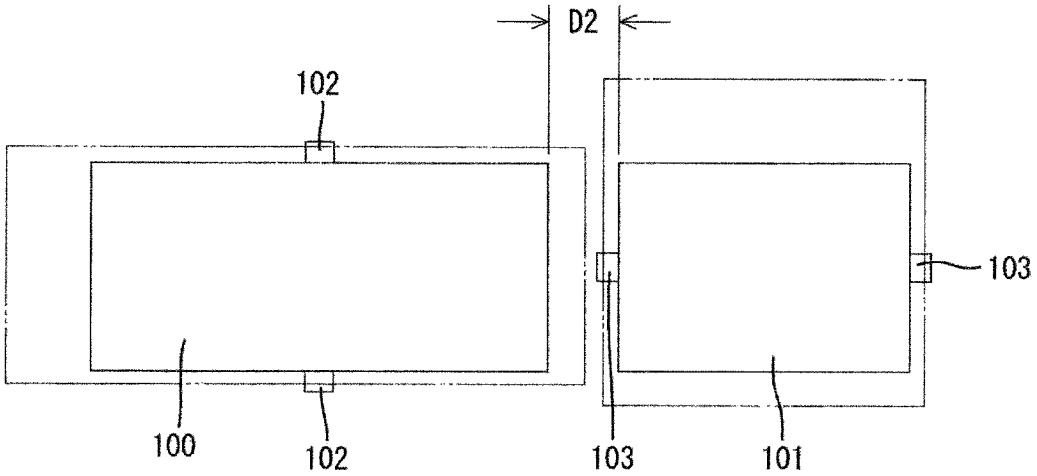
FIG. 36(A) is a diagram showing an effect of the present invention and FIG. 36(B) is a diagram showing a problem of a prior art.
Figure 36:
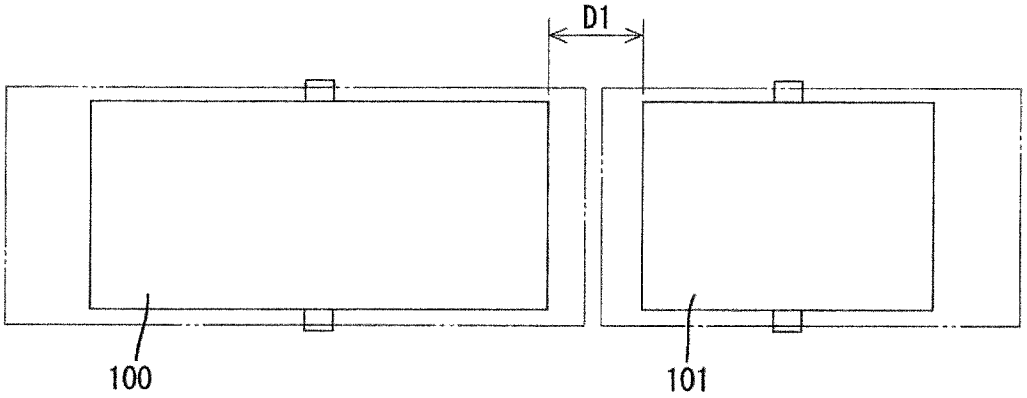
FIG. 36 (B) (PRIOR ART)

FIGS. 36(A) and 36(B) show adjacent fixed connectors 100, 101. FIG. 36B shows the prior art arrangement where surfaces with cam followers 102, 103 are parallel, while FIG. 36A conceptually shows the invention where surfaces with the cam followers are perpendicular. In either case, rotating directions of levers on mating connectors are parallel to the surfaces with the cam followers 102, 103. Areas enclosed by imaginary lines in FIGS. 36(A) and 36(B) schematically show rotation ranges of the levers. Force multiplying actions of a lever can be made stronger by lengthening the lever so that the lever projects more from the connector. Tips of the levers that projecting from the prior art connectors of FIG. 36B face each other and may interfere with each other. Therefore, an interval D1 between the prior art fixed-side connectors has to be widened. However, the subject invention avoids interference of the levers and narrows the interval between the fixed-side connectors to D2, where D2<D1, as shown in FIG. 36A.

Figure 1:
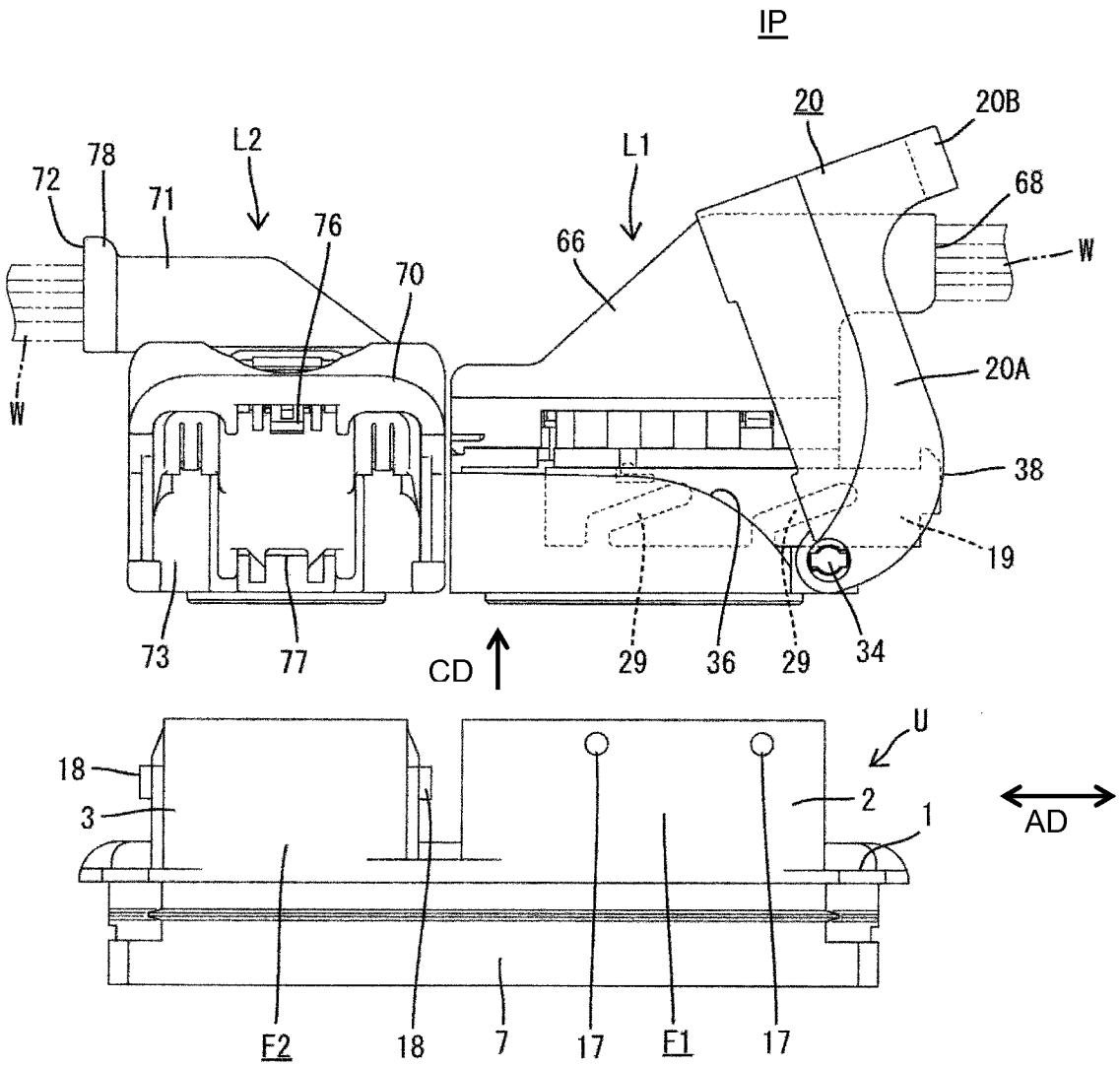
FIG. 1 is a side view showing a state before a connector with a force multiplying mechanism according to an embodiment is connected
Figure 2:
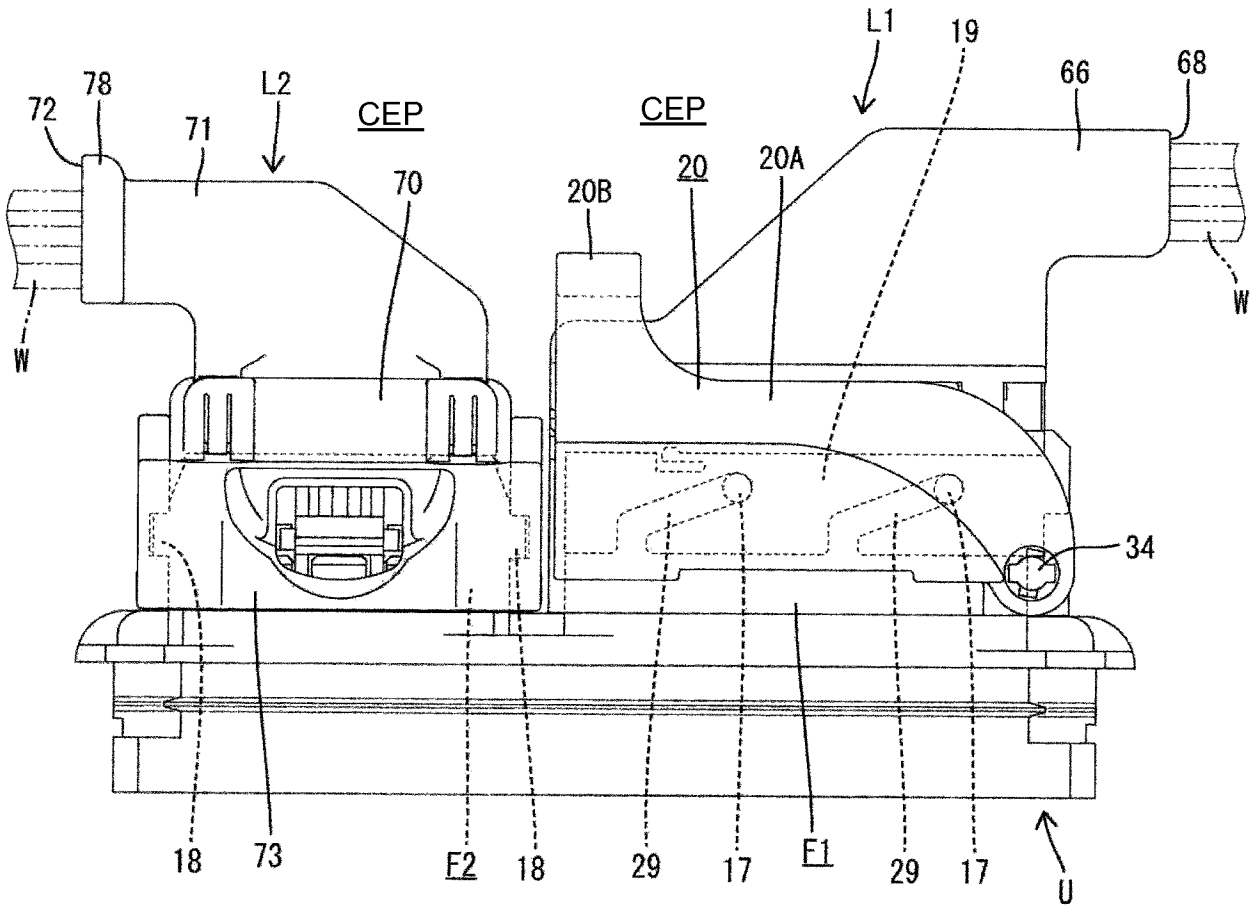
FIG. 2 is a side view showing the state after the connector is connected.

FIGS. 1-35 show a specific embodiment of the inventive concept shown in FIG. 36A. More particularly, a connector with the force multiplying mechanism in accordance with the invention includes a fixed connector unit U with first and second fixed connectors F1, F2 arranged substantially side by side on a board 1, as shown in FIGS. 1 and 2. First and second lever connectors L1, L2 connectable to the respective fixed connectors F1, F2.

Figure 3:
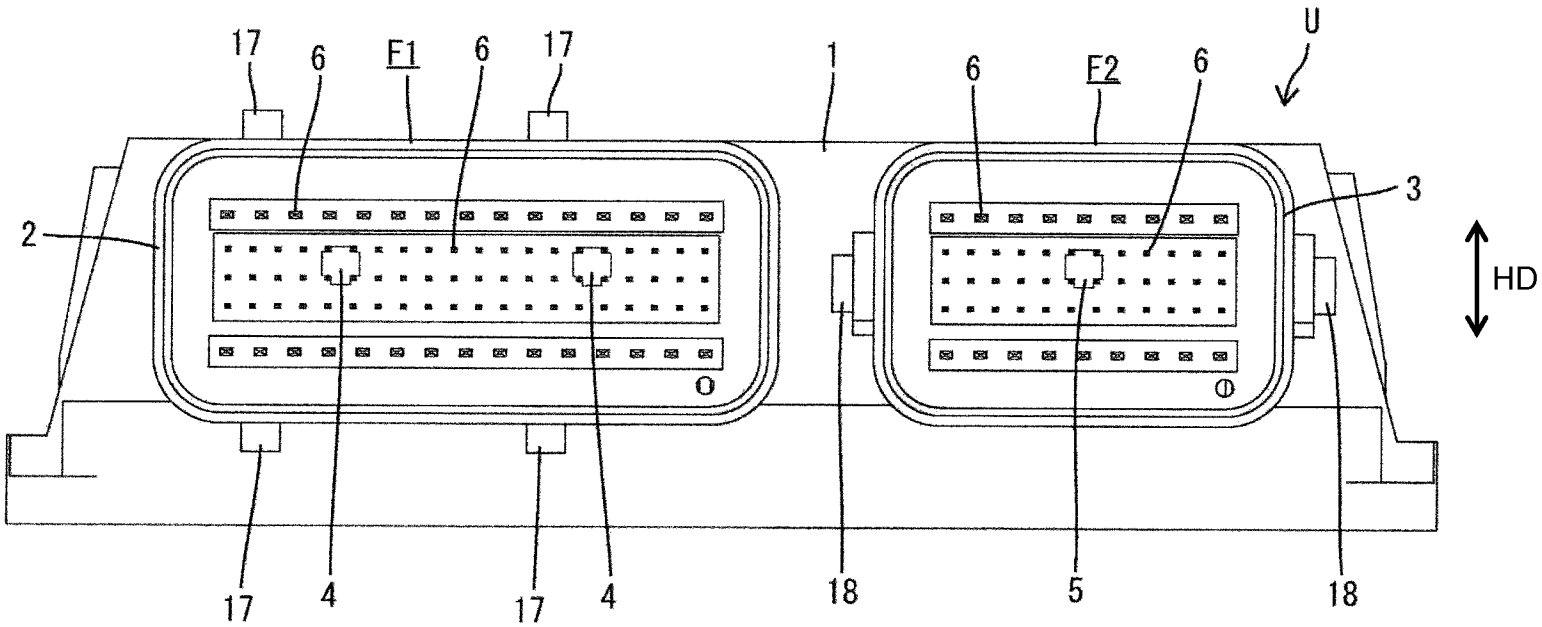
FIG. 3 is a front view of a fixed-side connector unit.

The fixed connector unit U includes the board 1 and the first and second fixed connectors F1, F2 mounted on the board 1. As shown in FIG. 3, the first and second fixed connectors F1, F2 are mounted on the board 1 so that their long sides are aligned along an arrangement direction of the fixed connectors F1, F2.

The fixed connectors F1, F2 include substantially rectangular tubular receptacles 2, 3 projecting forward (up in FIG. 1) in a connecting direction CD from the board 1. As shown in FIG. 3, guide projection shafts 4, 5 project unitarily from the back wall of the receptacle 2, 3 toward a connection surface of each fixed connector F1, F2 for guiding connection to the lever connectors L1, L2. Two guide projection shafts 4 are arranged substantially side by side in a longitudinal direction in the first fixed connector F1 and at least one guide projection shaft 5 is arranged substantially in a central part of the second fixed connector F2. Each guide projection shaft 4, 5 has a substantially crisscross cross-section. The guide projection shafts 4, 5 penetrate through the corresponding lever connector L1, L2 to reach a one-piece rubber plug 39 mounted in the lever connector L1, L2 when the fixed connectors F1, F2 and the lever connectors L1, L2 are connected.

Rod-shaped male terminal fittings 6 project in each of the receptacles 2, 3. In this embodiment, more male terminal fittings 6 are mounted in the first fixed connector F1 than in the second fixed-side connector F2, so that the first fixed connector F1 has more poles. Each male terminal fitting 6 is press-fit into the back wall of the corresponding receptacle 2, 3 and is bent down at a substantially right angle.

Figure 4:
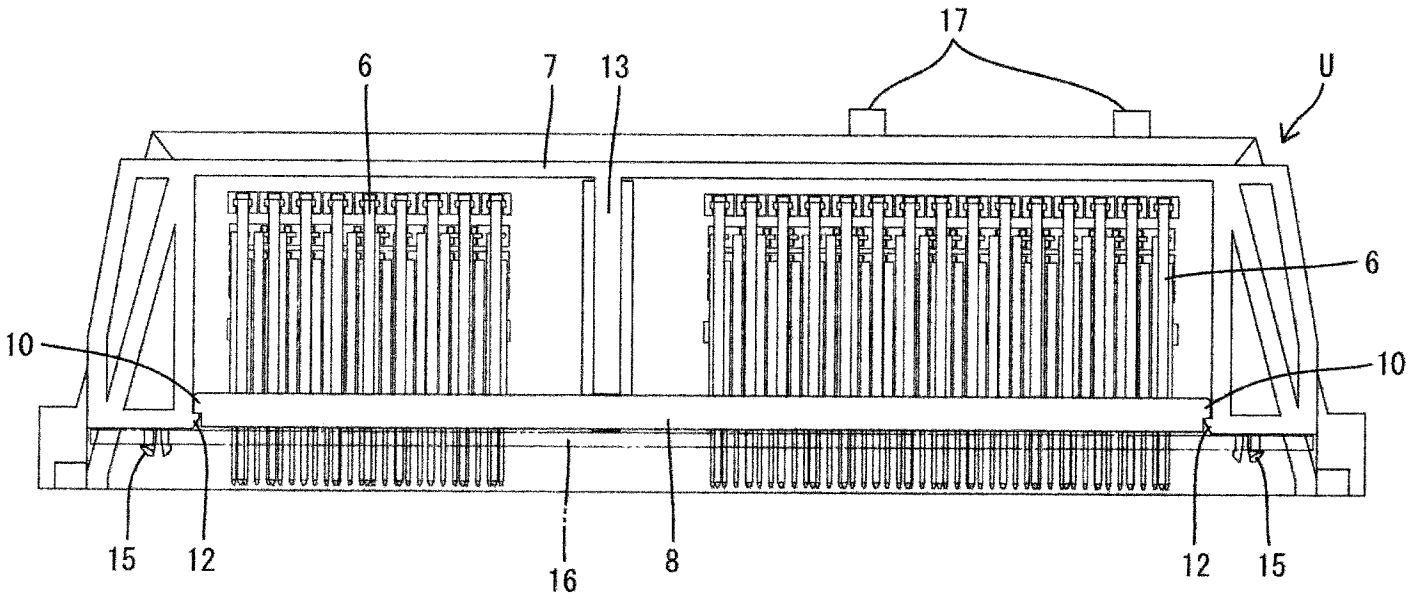
FIG. 4 is a rear view of the fixed-side connector unit.
Figure 30:
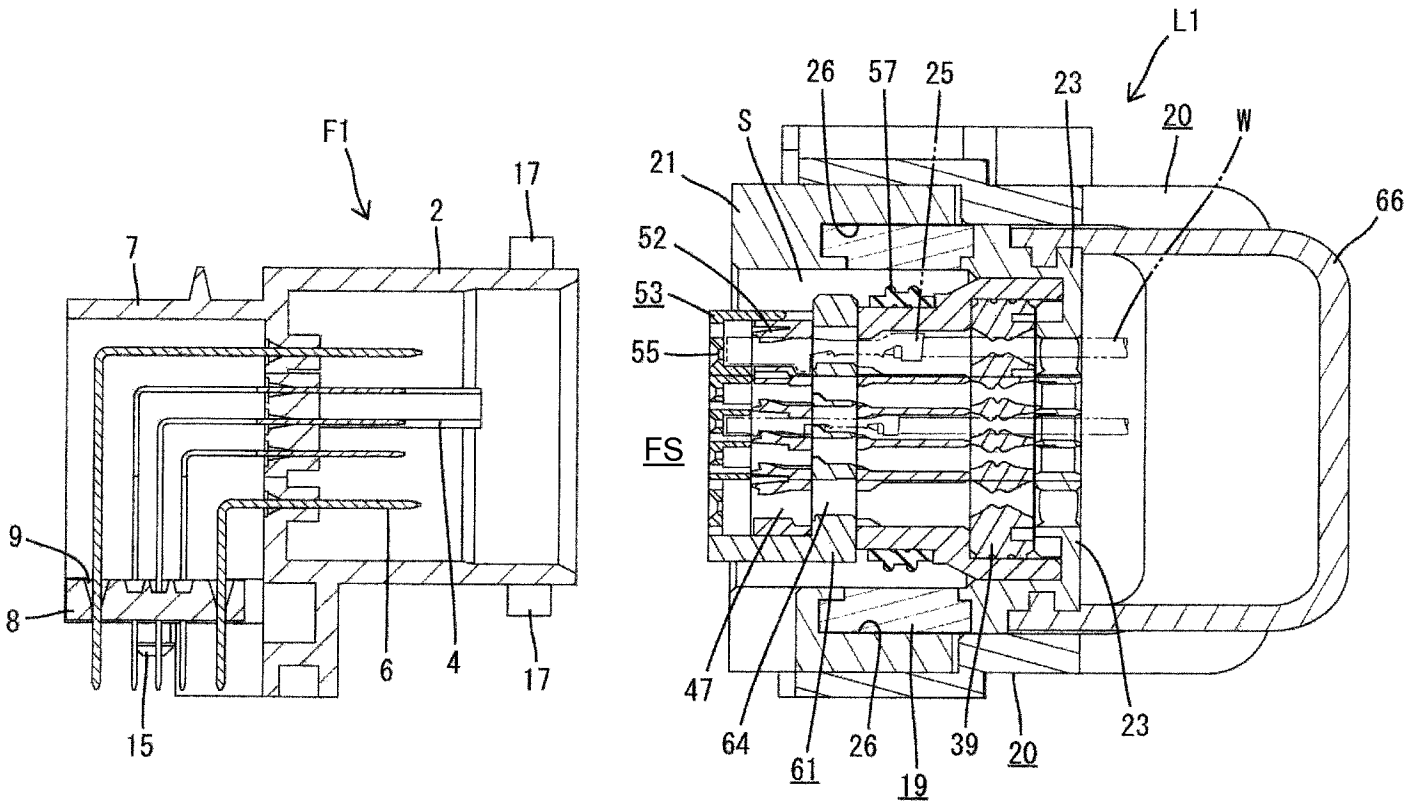
FIG. 30 is a section showing a state before the first fixed-side connector and the first lever-side connector are connected.
Figure 31:
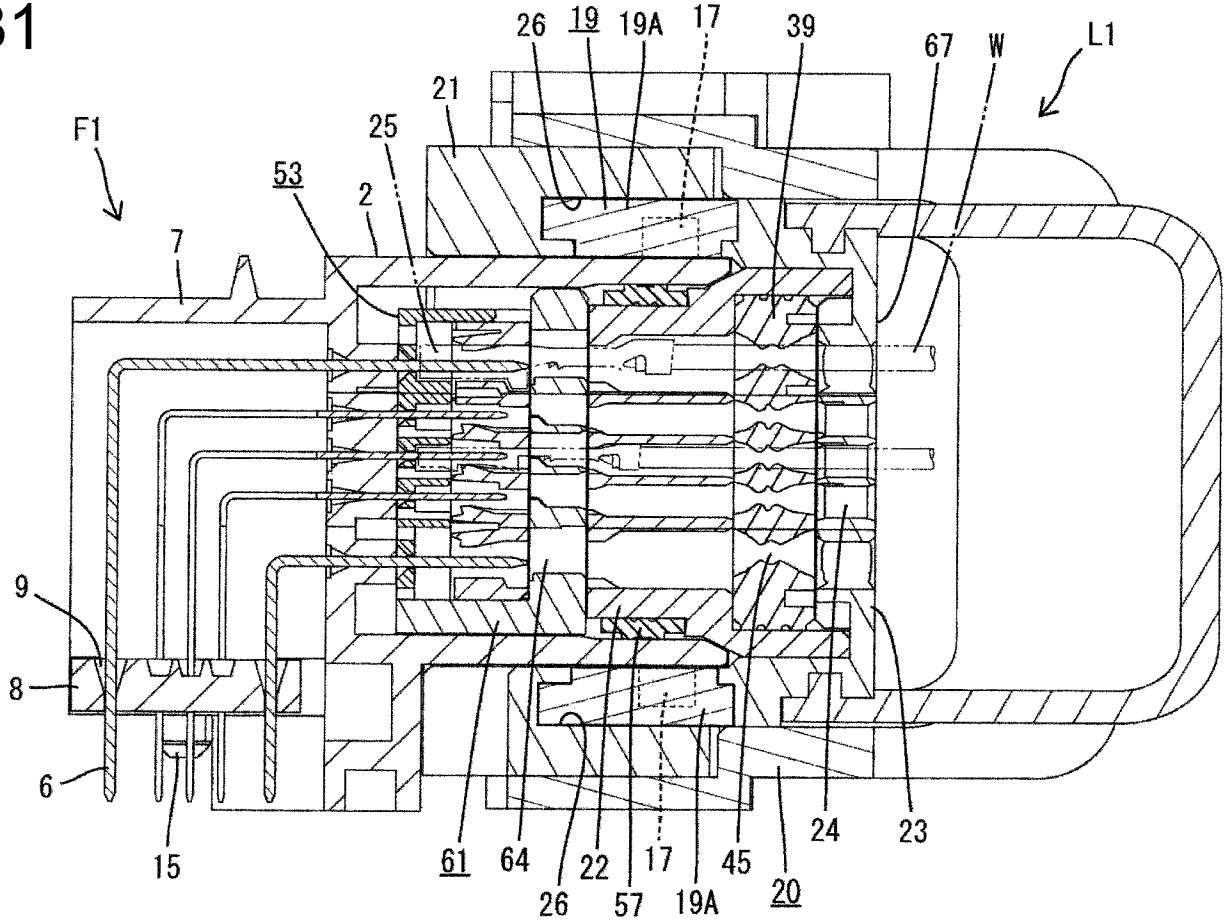
FIG. 31 is a section showing a state when the connection is completed.
Figure 32:
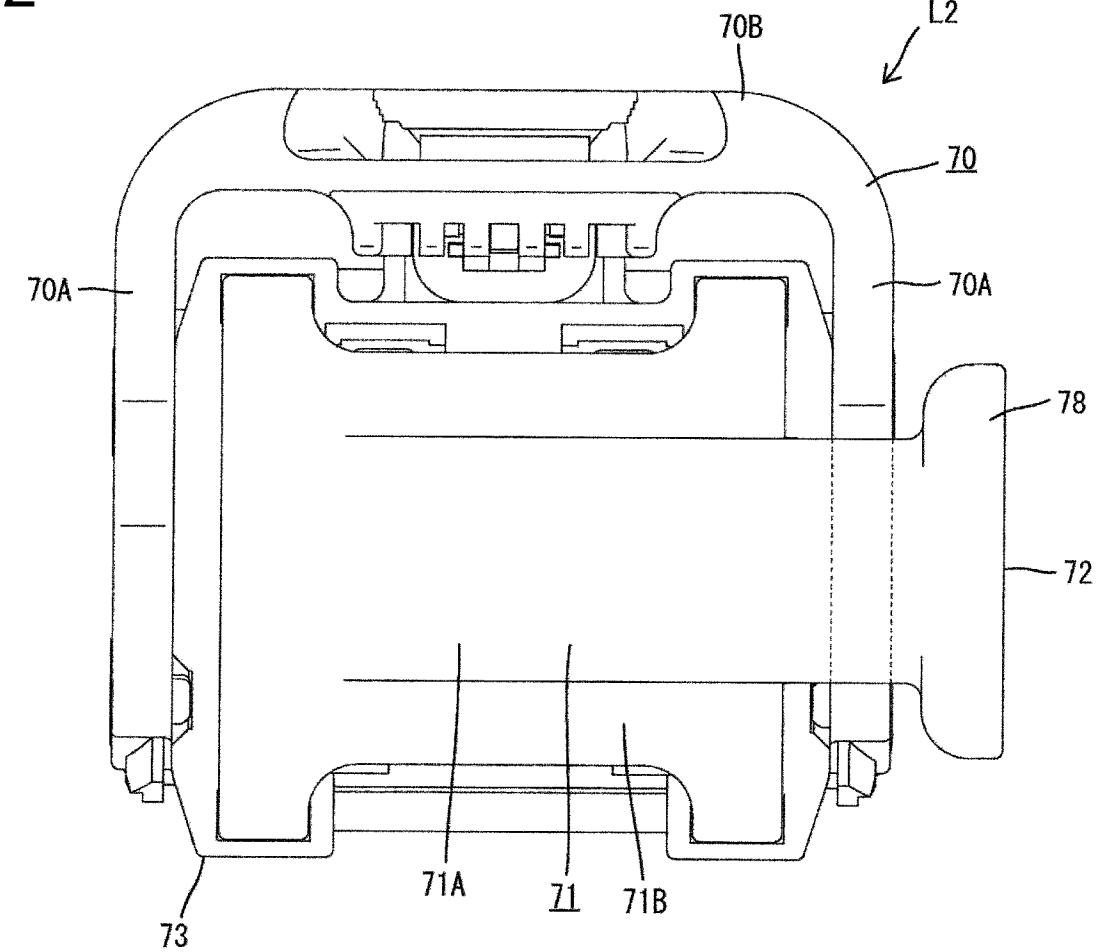
FIG. 32 is a rear view when a lever is at a connection end position in a second lever-side connector.

A protection wall 7 is provided on the rear of the board 1 for partly surrounding groups of the male terminal fittings 6 projecting from the board 1 (see FIGS. 4 and 30). The protection wall 7 is provided in a range from an upper edge part to opposite short sides of the board 1 and protrudes in a projecting direction of the male terminal fittings 6.

Figure 5:
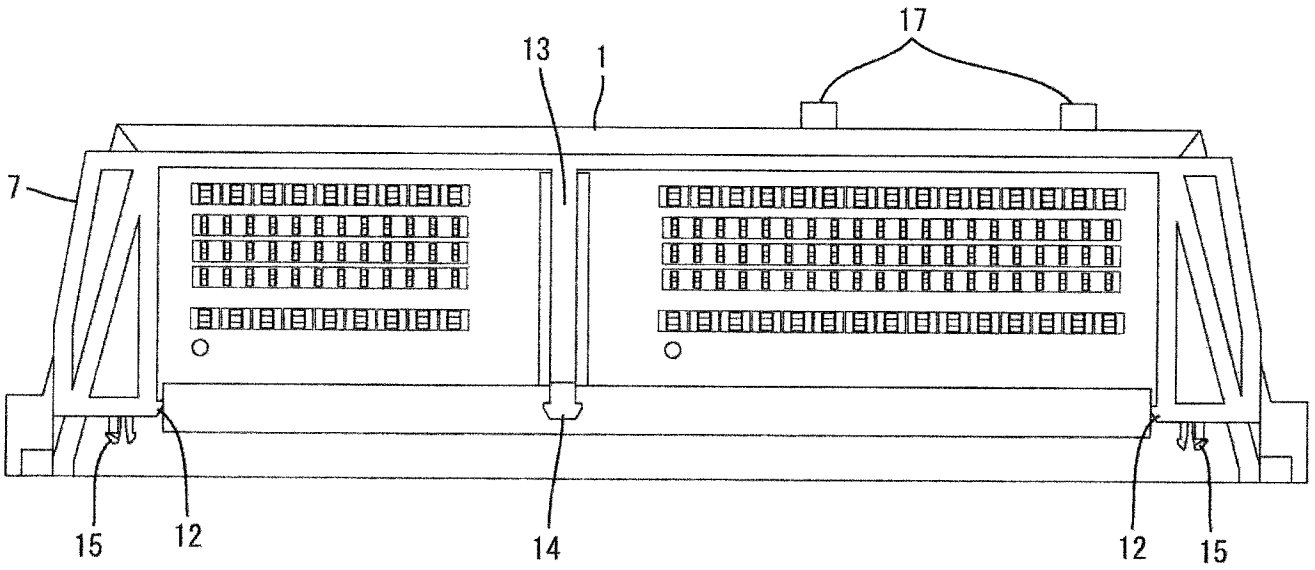
FIG. 5 is a rear view showing a state where an alignment plate is detached in FIG. 4.
Figure 6:
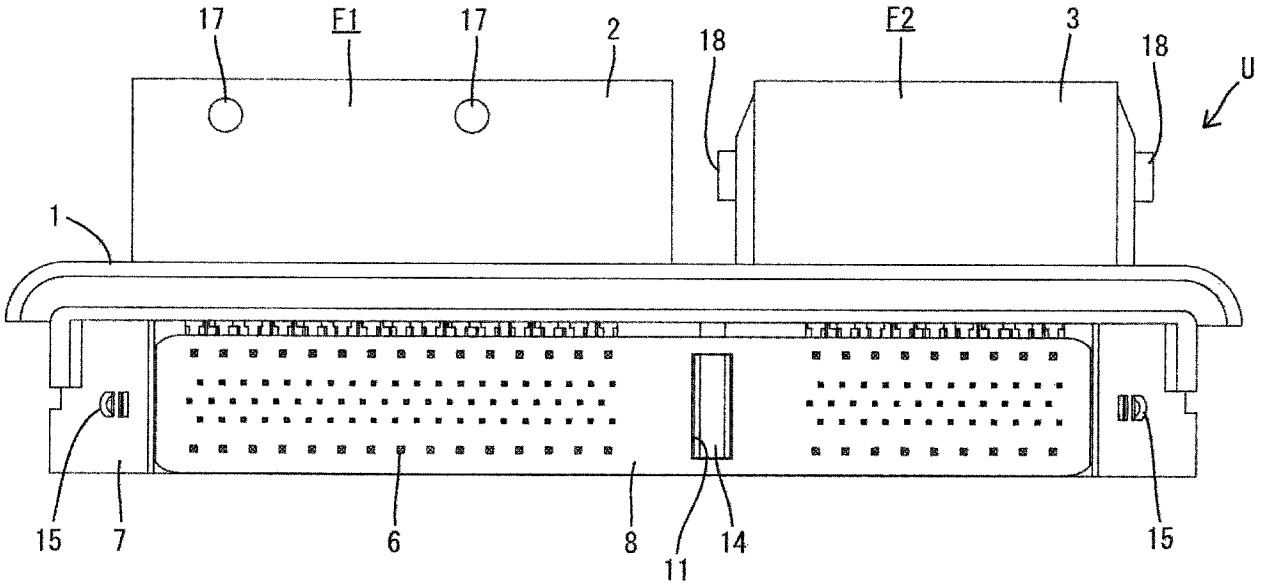
FIG. 6 is a bottom view of the fixed-side connector unit.
Figure 7:
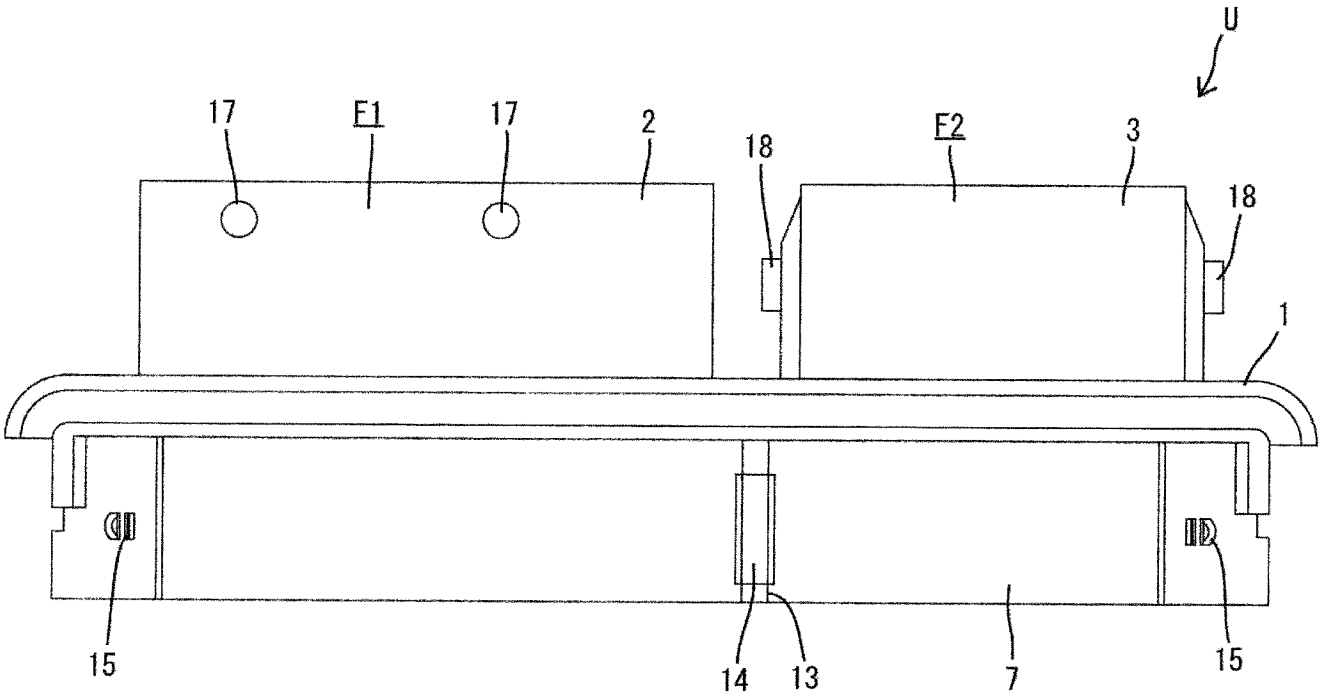
FIG. 7 is a rear view showing a state where the alignment plate is detached in FIG. 6.
Figure 8:
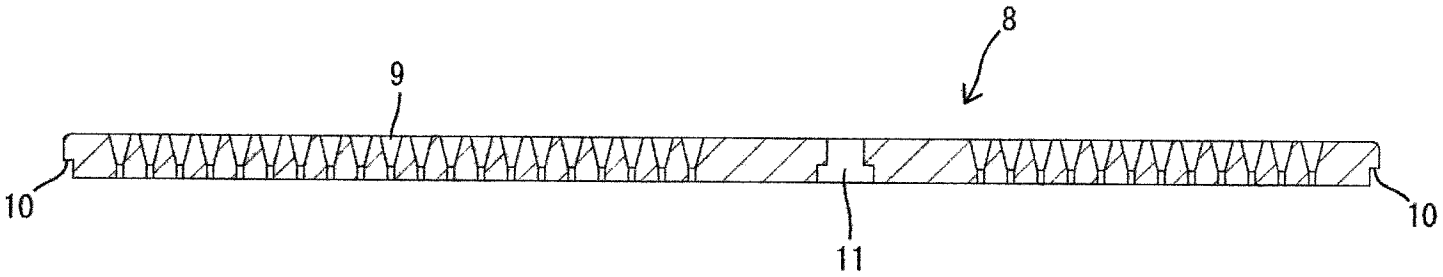
FIG. 8 is a section of the alignment plate.
Figure 9:
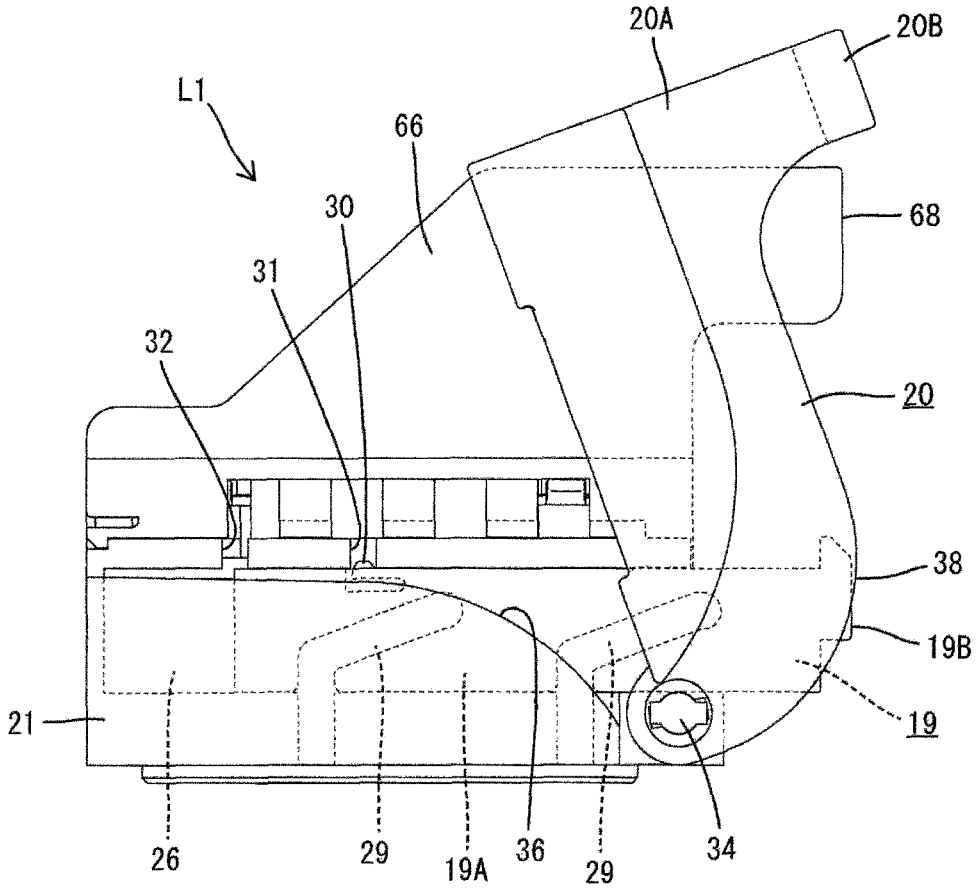
FIG. 9 is a side view showing a first lever-side connector when a lever is at an initial position.
Figure 10:
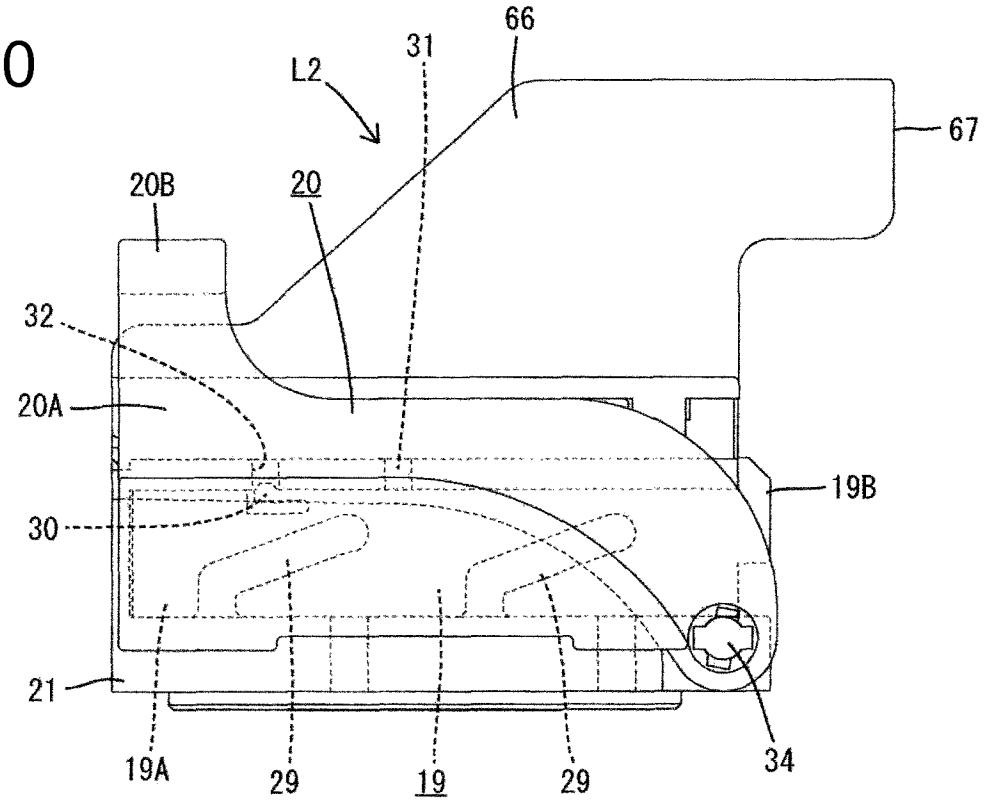
FIG. 10 is a side view showing the first lever-side connector when the lever is at a connection end position.

As shown in FIG. 4, tips of the male terminal fittings 6 are inserted into positioning holes 9 that penetrate though a long flat alignment plate 8. As shown in FIGS. 6 and 8, arrangement areas of groups of positioning holes 9 are separated to correspond to the fixed connectors F1, F2. As shown in FIG. 8, stepped edges 10 are formed on both longitudinal ends of the alignment plate 8, and a stepped hole 11 penetrates between the arrangement areas of the positioning holes 9 in the alignment plate 8. On the other hand, hooks 12 face each other on lower ends of the side parts of the protection wall 7, as shown in FIG. 5, and the alignment plate 8 is held by hooking the stepped edges 10 on the hooks 12. A vertical intermediate wall 13 projects back at a position between the first and second fixed connectors F1, F2 on the rear surface of the board 1, and an intermediate holding portion 14 in the form of a hook is formed on a lower part of the intermediate wall 13, as shown in FIGS. 5 and 7. The intermediate holding portion 14 is inserted into the stepped hole 11 of the alignment plate 8 to be locked. Thus, the alignment plate 8 is held at an intermediate part to prevent deflection.

Clips 15 project on the lower ends of the opposite side panels of the protection wall 7, as shown in FIG. 5. The clips 15 are inserted into holes (not shown) on the printed circuit board 16 and are locked resiliently, as shown in FIG. 4, for temporary holding the printed board 16 until the male terminal fittings 6 are inserted into through holes (not shown) of the printed circuit board 16 and soldered.

Cam followers 17 project on each of the opposite long side surfaces of the receptacle 2 of the first fixed connector F1 and hence are on the sides that extend along the arrangement direction AD of the fixed-side connectors. The cam followers 17 are in the form of pin shafts and, as shown in FIG. 1, are at height positions near the opening edge of the receptacle 2, but are shifted away from the second fixed connector F2 with respect to a center line in the longitudinal direction of the receptacle 2. On the other hand, cam followers 18 of the second fixed connector F2 are formed on opposite outer surfaces of the short sides of the receptacle 3, and hence are on the sides that are substantially perpendicular to the arrangement direction AD of the fixed connectors F1, F2. The cam followers 18 on the second fixed connector F2 are arranged in central parts of the opposite short side surfaces in a height direction HD (see FIG. 3) and are lower than the cam followers 17 on the first fixed connector (see FIG. 1).

(First Lever Connector L1)

Figure 12:
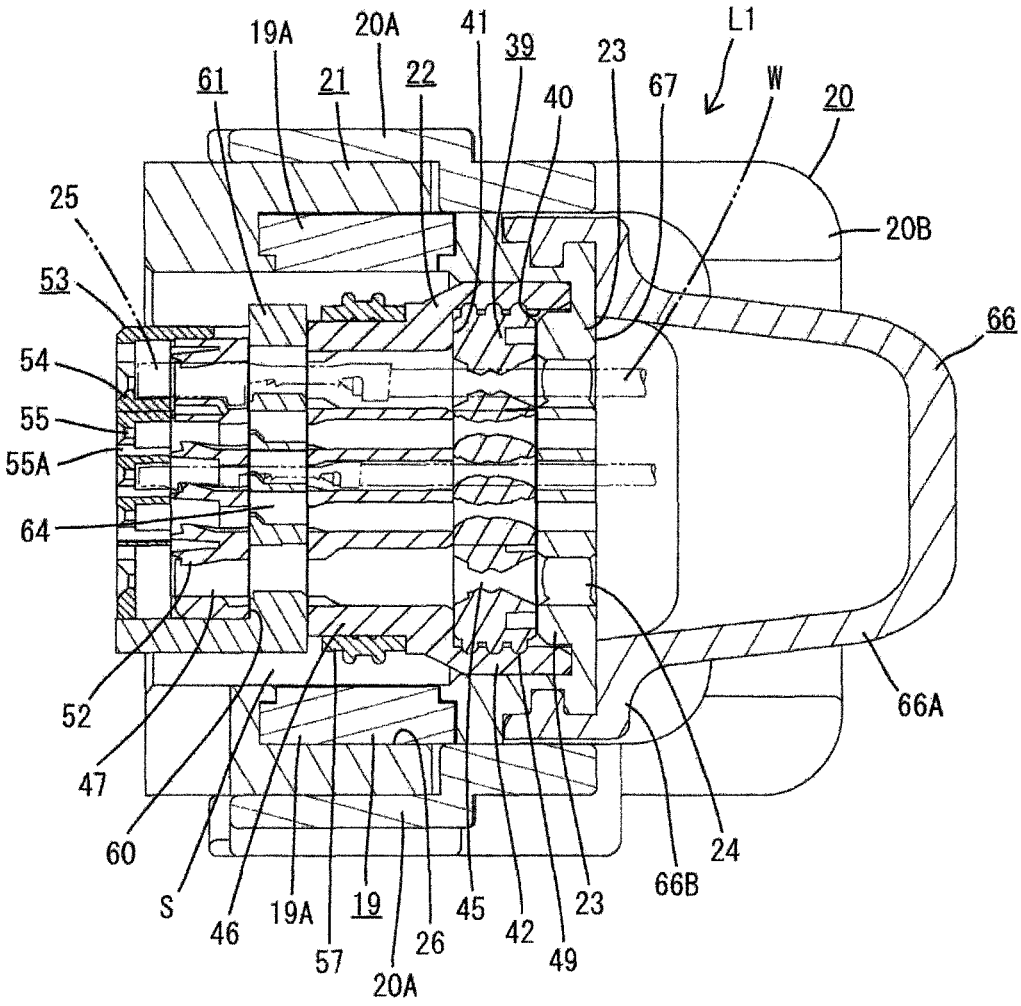
FIG. 12 is a section along A-A of FIG. 11.

A slider 19 is mounted into the first lever connector L1 (see FIGS. 28, 29) and functions as a force multiplying mechanism when engaged with the cam followers 17 of the first fixed connector F1. The first lever connector L1 also includes a lever 20 for moving the slider 19 (see FIGS. 9 and 10). As shown in FIG. 12, the first lever connector L1 has an outer housing 21 and an inner housing 22 that is mounted into the outer housing 21.

The outer housing 21 is a substantially rectangular tube that is open toward a front end FS that will face the first fixed-side connector F1, and the interior of the outer housing 21 defines an accommodation space for the inner housing 22. A wire drawing surface 67 is defined at the rear surface of the back wall 23 of the accommodation space of the outer housing 21 and wire insertion holes 24 penetrate through the wire drawing surface 67. Wires W connected to female terminal fittings 25 are drawn out to the outside of the outer housing 21. The back wall 23 also has two escaping holes 69A for allowing the guide projection shafts 4 of the first fixed connector F1 to escape.

Slider accommodating chambers 26 are formed at inner surfaces of opposite long sides of the outer housing 21 for accommodating the slider 19, as shown in FIG. 12. The slider accommodation chambers 26 have insertion openings 27 on one short side surface of the outer housing 21, and hence on an outer surface in the arrangement direction AD of the fixed-side connectors, as shown in FIG. 13.

Figure 14:
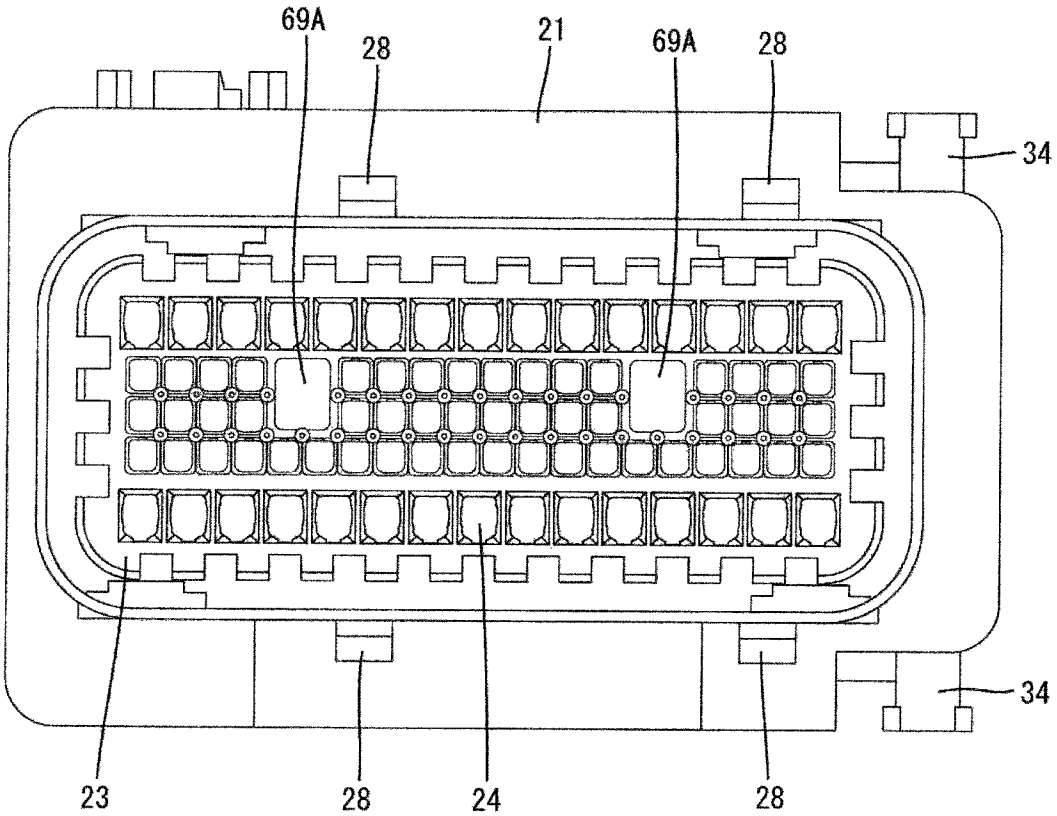
FIG. 14 is a front view of an outer housing of the first lever-side connector.

As shown in FIG. 14, entrance openings 28 are formed on a front wall of the outer housing 21 and are at positions to receive the respective cam followers 17 of the first fixed connector F1. The entrance openings 28 communicate with the corresponding slider accommodation chambers 26.

Figure 13:
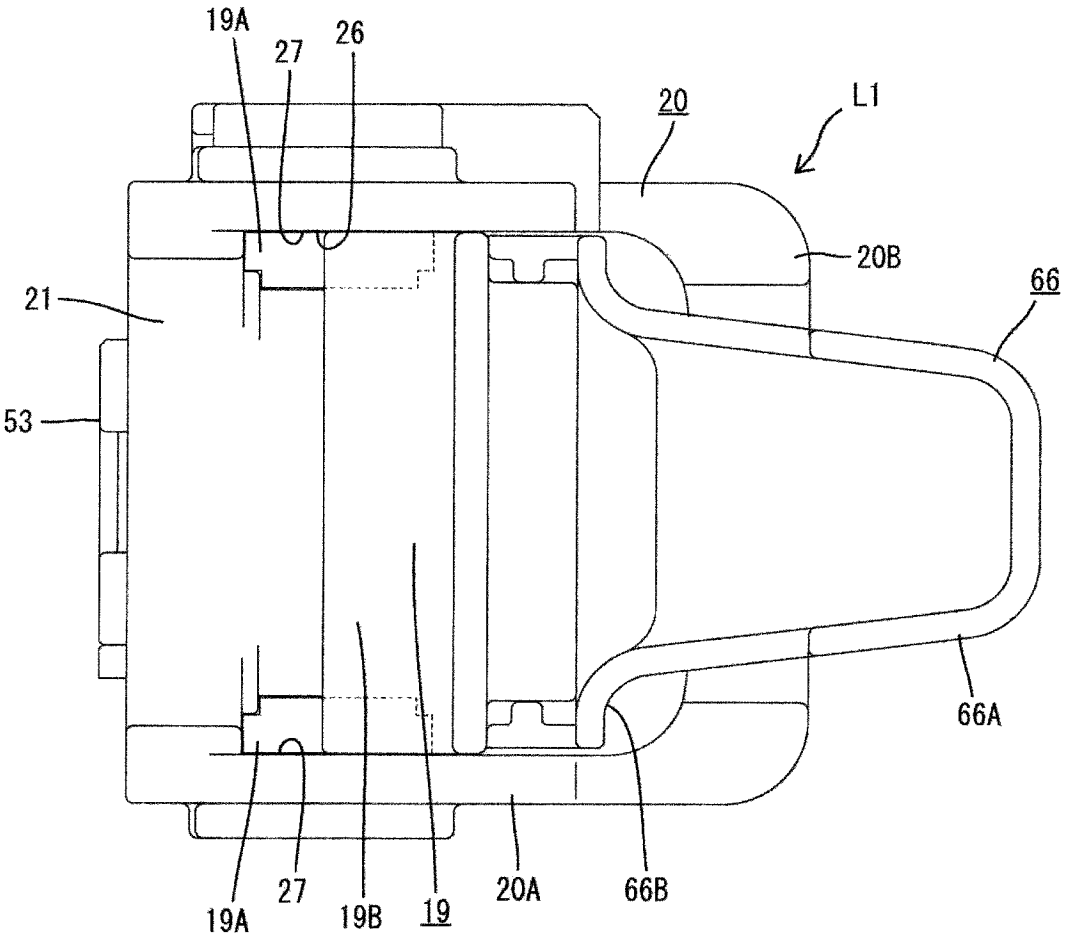
FIG. 13 is a view of the first lever-side connector of FIG. 11 when viewed in a direction of an arrow P.

As shown in FIG. 13, the slider 19 has two arms 19A that project from a coupling 19B. The arms 19A are accommodated slidably in the slider accommodation chambers 26. Specifically, sides of the arms 19A that face one another are recessed to form cam grooves 29 corresponding to the cam followers 17 of the first fixed-side connector F1 (see FIG. 21). The cam grooves 29 guide the first fixed connector F1 and the first lever connector L1 to a connected state while being engaged with the corresponding cam followers 17 and produce a force multiplying action as the slider 19 is slid.

Figure 28:
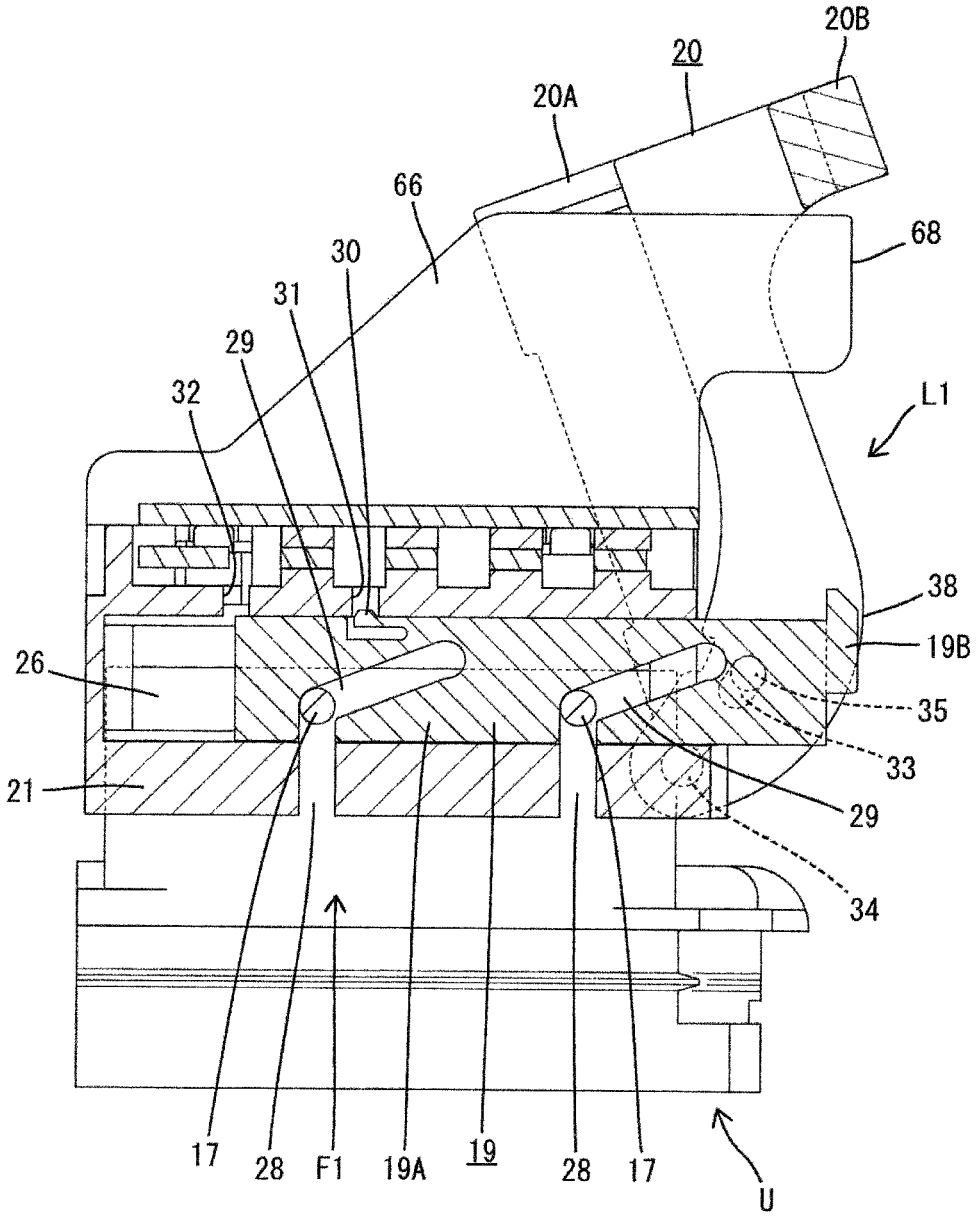
FIG. 28 is a section showing the position of the slider when a first fixed-side connector and the first lever-side connector are lightly connected and cam followers enter the entrances of cam grooves.
Figure 29:
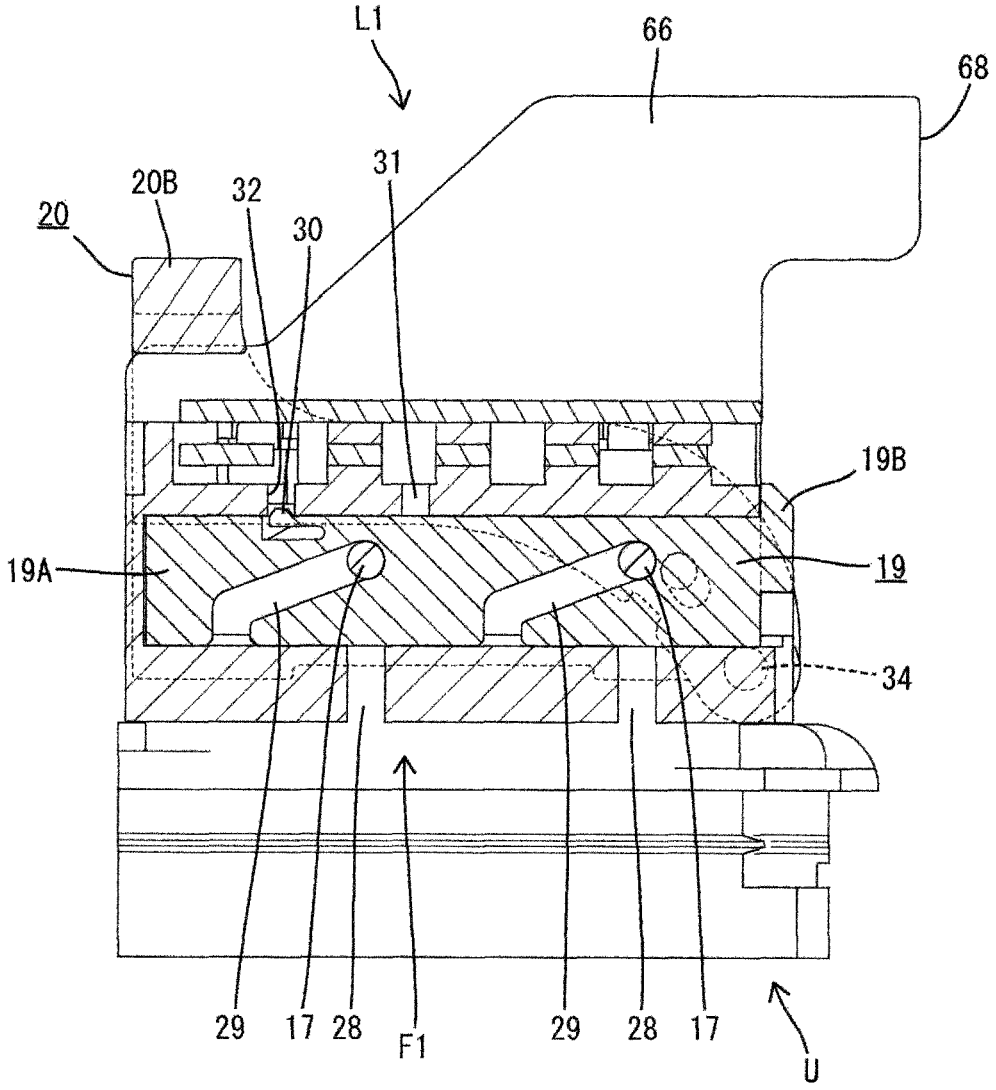
FIG. 29 is a section showing the position of the slider when the connection is completed.

As shown in FIGS. 28 and 29, a deflectable locking claw 30 is formed on an upper edge near a free end of each arm 19A of the slider 19. On the other hand, first and second locking recesses 31, 32 are formed at spaced apart positions in a moving direction of the slider 19 in each slider accommodation chamber 26 of the outer housing 21. The locking claws 30 lock in the first locking recesses 31 (state of FIG. 28) to hold the slider 19 at a start position projecting out from the outer housing 21 in the arrangement direction AD of the first and second fixed connectors F1, F2. The entrances of the cam grooves 29 of the slider 19 communicate with the corresponding entrance openings 28 when the slider 19 is at the movement start position and can receive the cam followers 17 of the first fixed connector F1. Rear surfaces of the locking claws 30 in an inserting direction of the slider 19 are inclined steeply and engage surfaces of the first locking recesses 31 to hold the slider 19 in the outer housing 21. On the other hand, front surfaces of the locking claw 30 are inclined more moderately. A specified pushing force applied to the slider 19 will release the locking claw 30 from the locked state in the first locking recesses 31 so that the slider 19 can move forward in a pushing direction. However, the front end surfaces of the locking claws 30 are sufficiently steep to avoid being released inadvertently from the locked state in the first locking recesses 31 unless a greater specified pushing force is applied to the slider 19.

The locking claws 30 are locked in the second locking recesses 32 (see FIG. 29) and the coupling 19B contacts a side wall surface of the outer housing 21 when the slider 19 is an end position. By this time, the cam followers 17 have reached the ends of the cam grooves 29 and the connection of the first fixed connector F1 and the first lever connector L1 has been completed. Note that a locking state of the locking claws 30 and the second locking recesses 32 can be released by applying a strong force to the slider 19 in a pulling direction.

As shown in FIG. 14, opposite side parts of the surface of the outer housing 21 formed with the insertion openings 27 for the slider are cut near the connection surface and rotary shafts 34 used to mount the lever 20 project in a short side direction.

Figure 21:
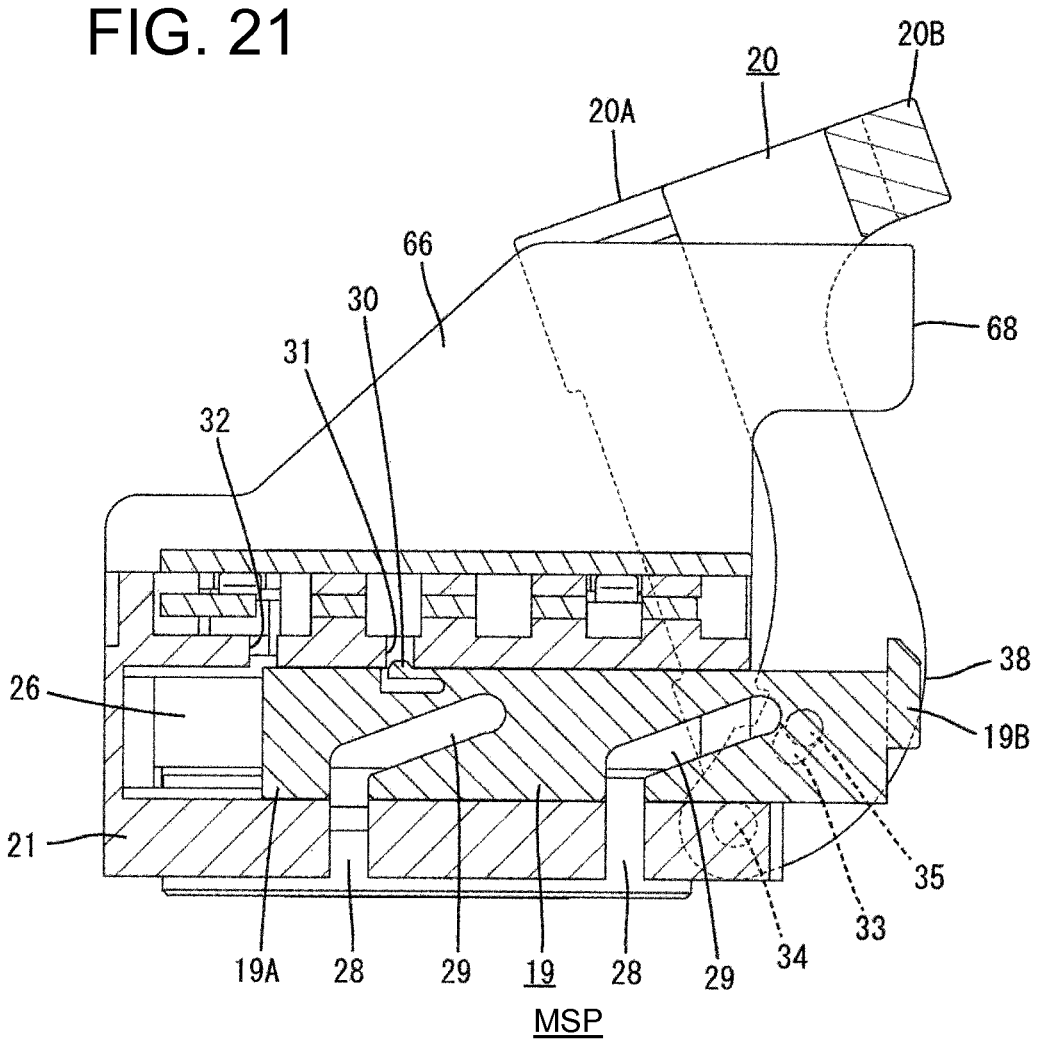
FIG. 21 is a section along E-E of FIG. 11 showing an accommodated state of a slider.
Figure 22:
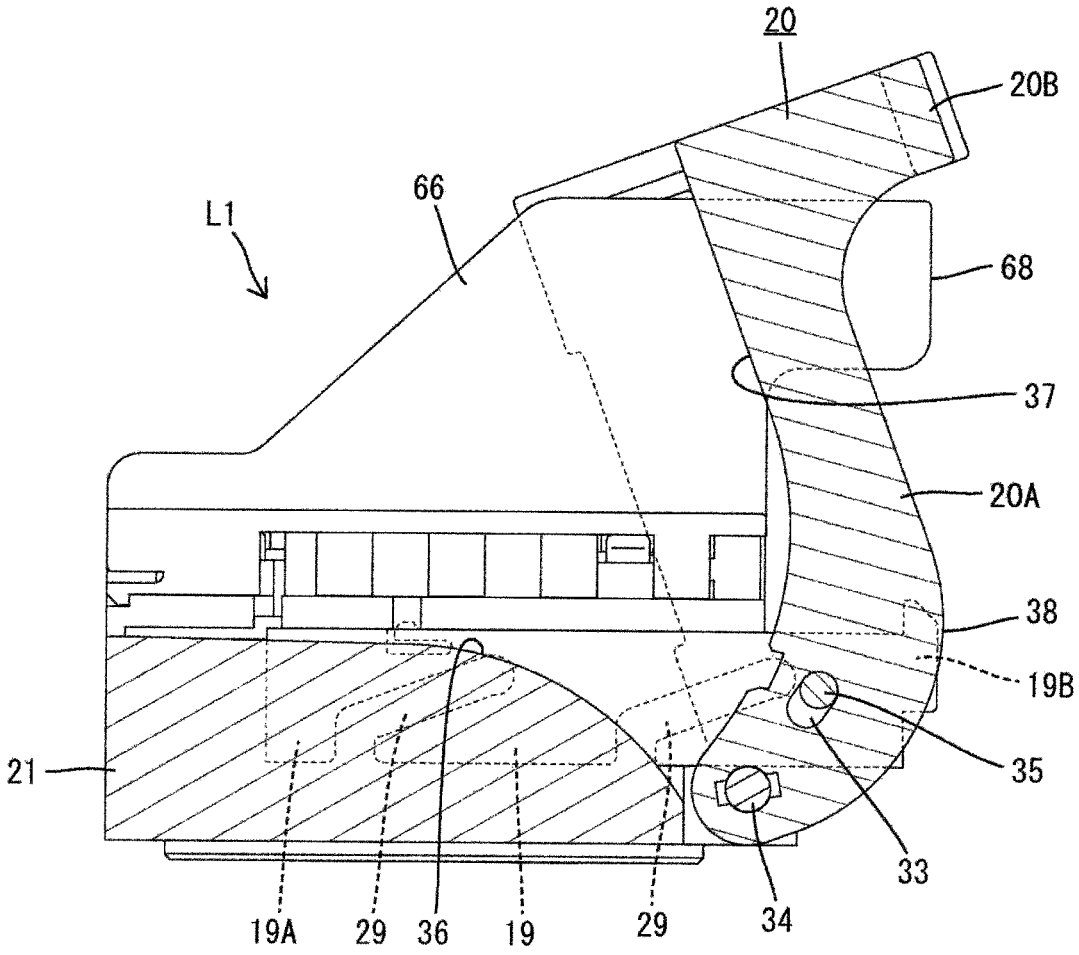
FIG. 22 is a section, corresponding to one along F-F of FIG. 11, showing a coupled state of the lever and the slider when the lever is at the initial position.
Figure 23:
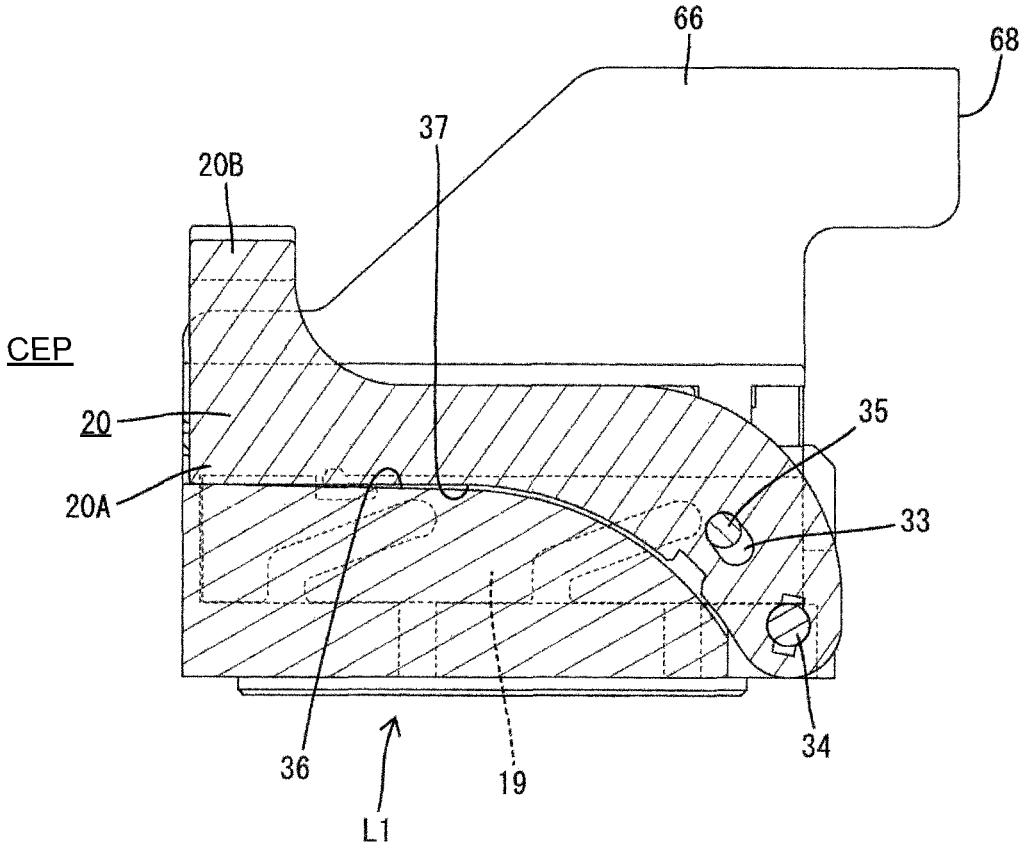
FIG. 23 is a section, corresponding to one along F-F of FIG. 11, showing the coupled state of the lever and the slider when the lever is at the connection end position.

The lever 20 is rotatable about the rotary shafts 34 between an initial position IP (FIG. 1) and a connection end position CEP (FIG. 2). The lever 20 has two lever plates 20A that straddle opposite long sides of the outer housing 21 and an operating portion 20B that couples ends of the lever plates 20A. The rotary shafts 34 are inserted into free ends of the lever plates 20A so that the entire lever 20 is rotatable about the rotary shafts 34. As shown in FIGS. 21 to 23, surfaces of the lever plates 20A that face one another are recessed to form linking grooves 33 in the form of long holes. Connection pins 35 on the outer surfaces of the arms 19A of the slider 19 near the coupling 19B fit into the linking grooves 33 so that the slider 19 can be slid in tandem with a rotational of the lever 20.

As shown in FIG. 1, step-like stopper edges 36 protrude out on the opposite long side surfaces of the outer housing 21 for preventing any further rotation of the lever 20 at the connection end position CEP. Specifically, the opposite long side surfaces of the outer housing 21 are so formed that lower areas below the stopper edges 36 protrude out. Each stopper edge 36 extends horizontally along the arrangement direction AD of the fixed-side connectors from an end part facing the second fixed connector F2 and then curves arcuately down toward the rotary shaft 34.

Inner surfaces of both lever plates 20A of the lever 20 have step-like contact edges 37 that conform to the shape of the stopper edges 36, as shown in FIGS. 22 and 23, and lower areas below the contact edges 37 protrude out. The contact edges 37 contact the stopper edges 36 to prevent rotation of the lever 20 at the connection end position CEP. Note that, as shown in FIG. 23, the outer surfaces of the operating portion 20B of the lever 20 and the outer short side surfaces of the outer housing 21 are substantially flush with each other when the lever is at the connection end position.

The coupling 19B of the slider 19 projects out from the outer housing 21 when the lever 20 is at the initial position IP and the slider 19 is at the start position MSP, as shown in FIG. 21. At this time, projecting edges 38 of the side edges of the lever plates 20A of the lever 20 corresponding to a projecting end part of the slider 19 in the shown height direction HD are at substantially the same position as or behind the projecting end part of the slider 19 in a mounting direction of the slider 19. Thus, external matter that approaches the projecting end of the slider 19 from behind in the mounting direction of the slider 19 is more likely to contact the protecting edges 38 of the lever 20 than the projection end part of the slider 19. Further, as is also clear from FIG. 21, a distance from the rotary shafts 34 of the lever 20 to the protecting edges 38 is sufficiently shorter than a distance to the operating portion 20B of the lever 20 when viewed in a viewing direction of FIG. 21. Thus, a pushing force applied to the protecting edges 38 to release the locking claws 30 from the locked state is considerably larger as compared with the case where the operating portion 20B is operated. Therefore, the locking claws 30 are less likely to be released from the locked state when a pushing force is applied to the protecting edges 38 than when the same pushing force is applied directly to the slider 19.

Figure 18:
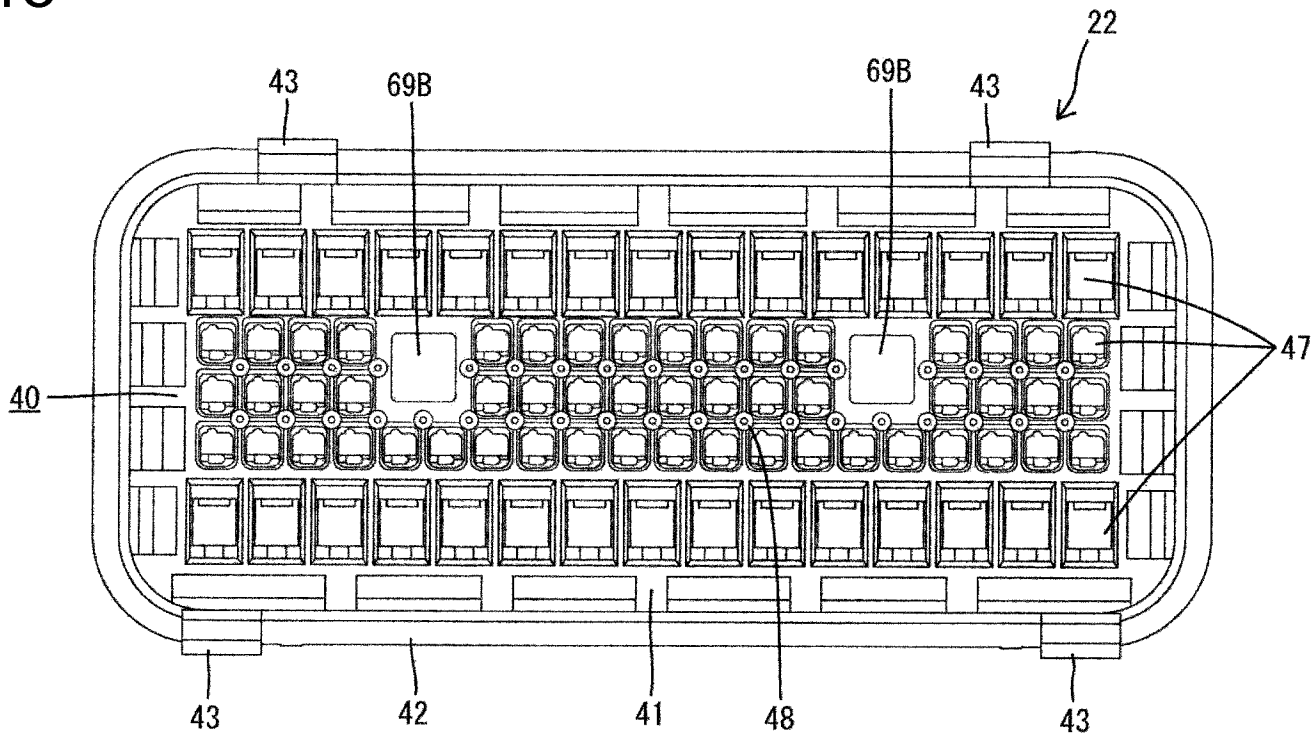
FIG. 18 is a rear view of an inner housing.
Figure 26:
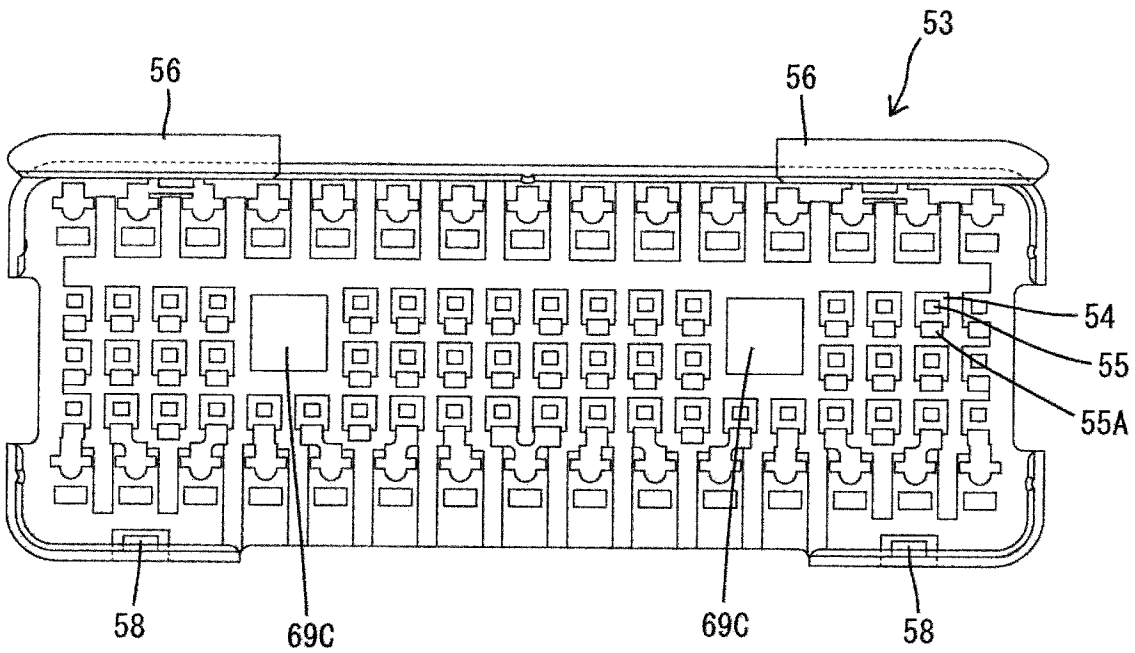
FIG. 26 is a section, corresponding to one along B-B of FIG. 11, showing a state where the retainer is at a partial locking position.
Figure 27:
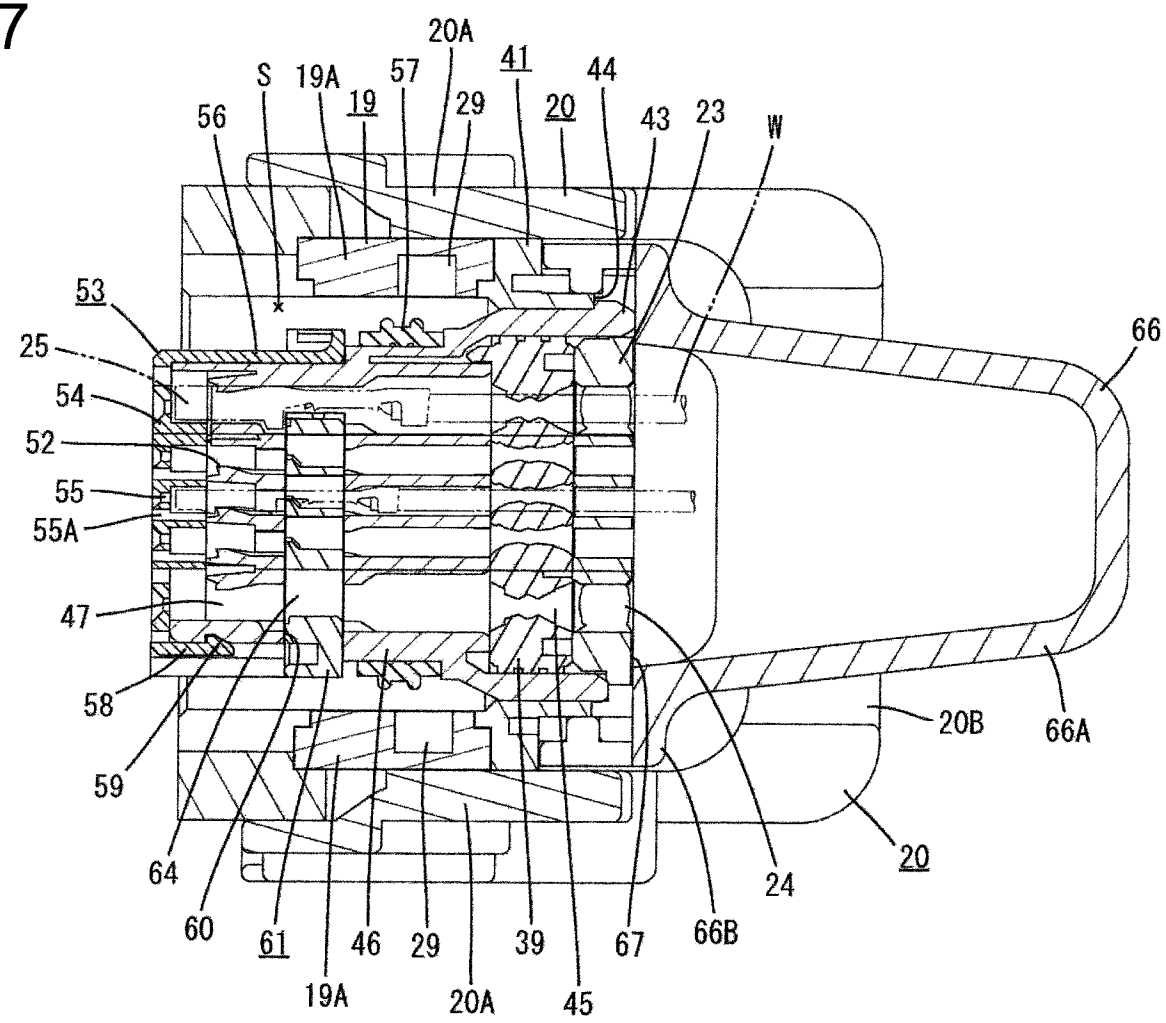
FIG. 27 is a section, corresponding to one along B-B of FIG. 11, showing a state where the retainer is at a full locking position.

As shown in FIG. 12, the resilient or one-piece rubber plug 39 is to be mounted on a rear surface side of the inner housing 22. A rubber plug accommodating portion 40 for accommodating the one-piece rubber plug 39 is formed in a rear part of the inner housing 22. The rubber plug accommodating portion 40 is formed inside a rectangular tubular part extending back from the peripheral edge of the rear end surface of the inner housing 22. As shown in FIG. 18, two lock projections 43 for the outer housing 21 are formed on a tip part of each of the upper and lower surfaces of a peripheral wall 42 of the inner housing 22. An interval between the lock projections 43 arranged on an upper side is narrower than that between the lock projections 43 on a lower side. On the other hand, as shown in FIGS. 26 and 27, the back wall 23 of the outer housing 21 is formed with lock receiving edges 44 corresponding to the respective lock projections 43. The lock projections 43 and the lock receiving edges 44 will not correspond due to an interval difference and interfere with each other if the inner housing 22 is attempted to be mounted into the outer housing 21 in an improper orientation e.g. a vertically inverted posture a proper posture so that the housings cannot be assembled.

The partition wall 41 of the inner housing 22 partitions between the rubber plug accommodating portion 40 and a terminal accommodating portion 46 for accommodating the female terminal fittings 25. Rear ends of cavities 47 for accommodating the female terminal fittings 25 are open on the partition wall 41 and communicate with wire insertion holes 45 of the one-piece rubber plug 39 and the wire insertion holes 24 of the back wall 23 of the outer housing 21. Two escaping holes 69B penetrate the partition wall 41 for allowing the guide projection shafts 4 of the first fixed connector F1 to escape.

As shown in FIG. 12, the one-piece rubber plug 39 is to be mounted substantially in contact with the rear surface of the partition wall 41 and held by being sandwiched between the inner housing 22 and the back wall 23 of the outer housing 21 when the inner housing 22 is mounted into the outer housing 21.

Figure 19:
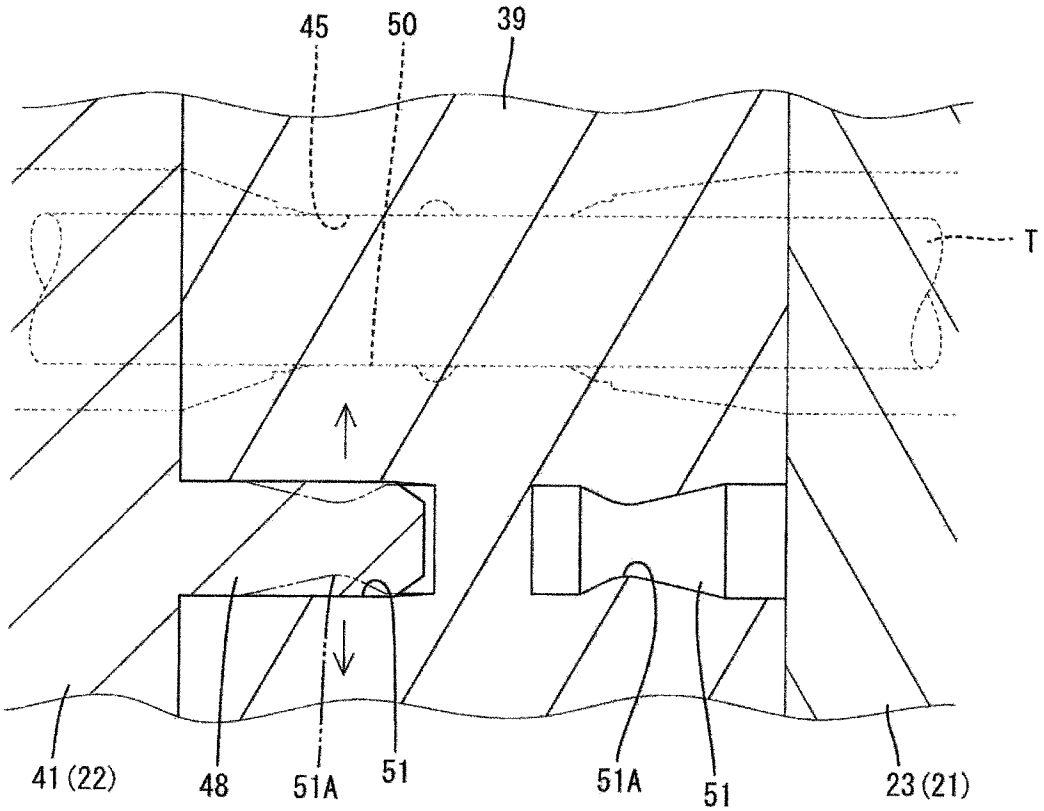
FIG. 19 is an enlarged section showing a fitted state of positioning pins and the positioning holes.
Figure 20:
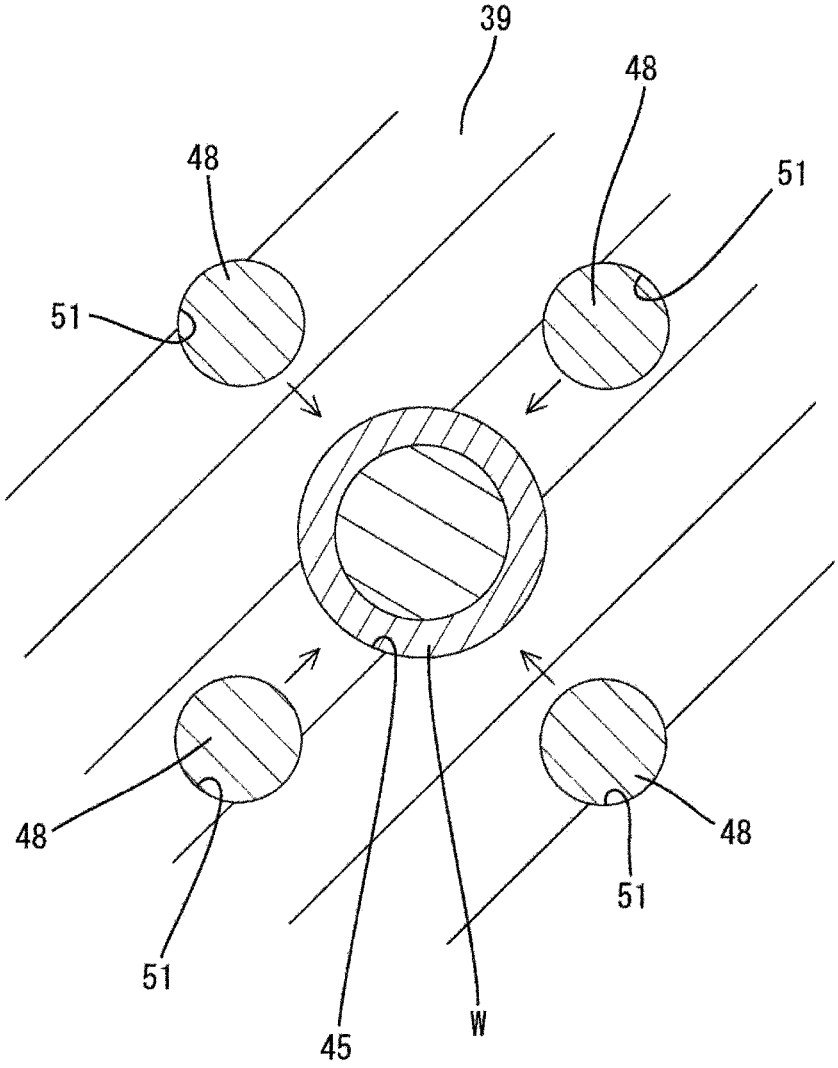
FIG. 20 is a diagram showing the influence of the insertion of the positioning pins into the positioning holes on a sealed state of the wire in the wire insertion hole.

FIG. 18 shows the inner housing 22 when viewed from the side of the rubber plug accommodating portion 40. As shown in FIGS. 18 and 19, positioning pins 48 are arranged on a rear surface side of the partition wall 41 along a central part in the height direction HD. Specifically, as shown in FIG. 18, arrangement areas of the wire insertion holes 45 formed in the partition wall 41 are divided in three rows e.g. according to the size of the female terminal fittings 25 to be inserted, and the positioning pins 48 are arranged at diagonal positions around the respective wire insertion holes 45 in the middle row in the middle arrangement area. Each positioning pin 48 is substantially cylindrical.

Figure 15:
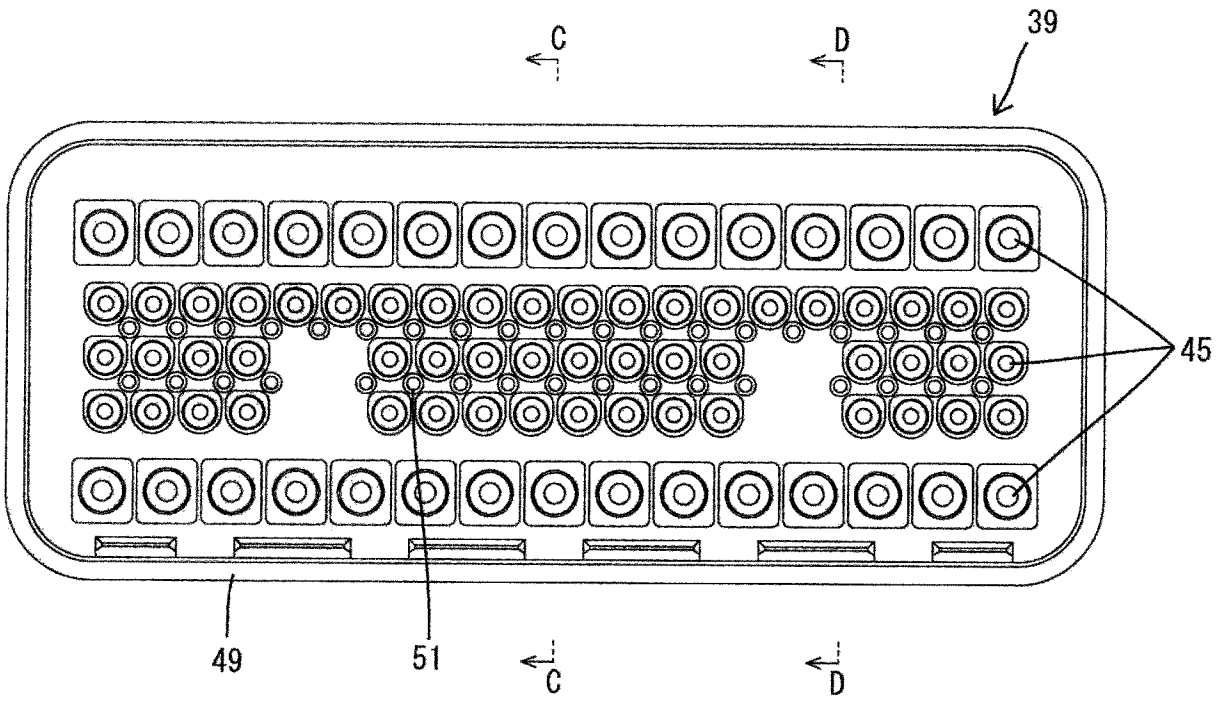
FIG. 15 is a front view of a one-piece rubber plug.
Figure 16:
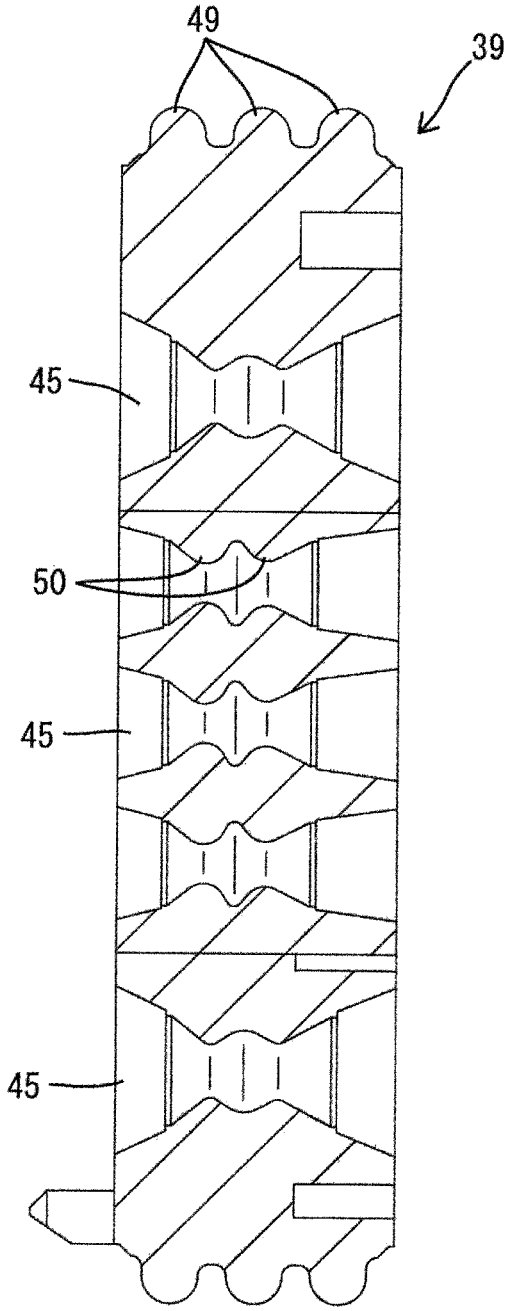
FIG. 16 is a section along C-C of FIG. 15 showing wire insertion holes.
Figure 17:
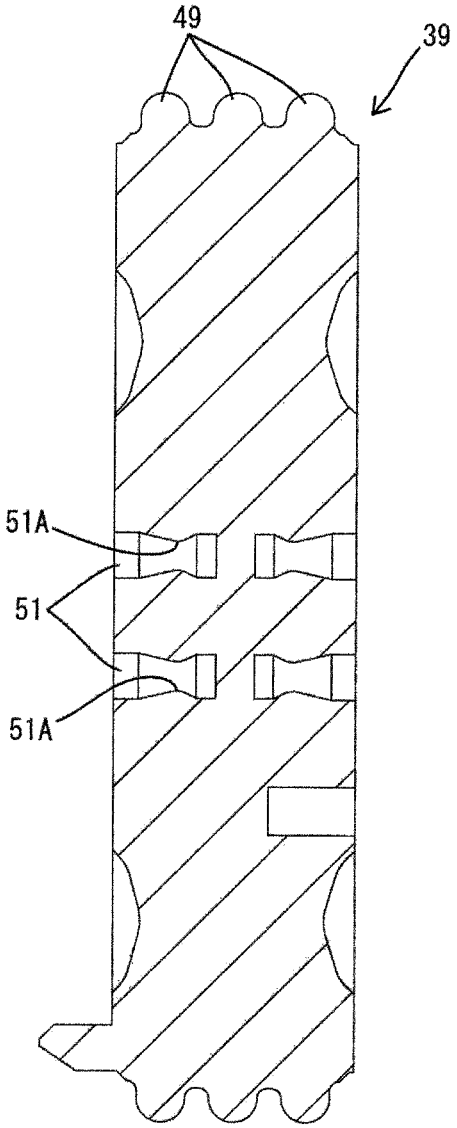
FIG. 17 is a section along D-D of FIG. 15 showing positioning holes.

The one-piece rubber plug 39 is accommodated in the rubber plug accommodating portion 40 and three outer lips 49 are formed on the outer peripheral surface so that the one-piece rubber plug 39 can closely contact the inner peripheral surface of a peripheral wall of the rubber plug accommodating portion 40 in a sealed state. As shown in FIGS. 15 and 16, the wire insertion holes 45 penetrate the one-piece rubber plug 39. Two inner lips 50 are formed in each wire insertion hole 45 and contact the outer peripheral surface of an insulation coating of the wire W in a sealed state. Further, both front and rear surfaces of the one-piece rubber plug 39 are recessed to form positioning holes 51 at positions corresponding to the respective positioning pins 48 on the same axes. The positioning holes 51 are arranged at diagonal positions around the wire insertion holes 45 in the middle row and are located in a middle area of the one-piece rubber plug 39. Each positioning hole 51 has a diameter so that the positioning pin 48 can be press-fit therein and have a depth slightly longer than the entire length of the positioning pin 48. Further, as shown in FIG. 17, each positioning hole 51 has a narrowed portion 51A with a small diameter at a position near the back end. In this embodiment, as shown in FIG. 19, the narrowed portion 51A is formed at an axial position substantially aligned with an inner lip 50 in the wire insertion hole 45 of the one-piece rubber plug 39.

As shown in FIG. 12, forwardly open cavities 47 are formed in the terminal accommodating portion 46 of the inner housing 22 and receive the female terminal fittings. A deflectable locking lance 52 is formed in a front part of the interior of each cavity 47 and can resiliently lock the female terminal fitting 25.

Figure 11:
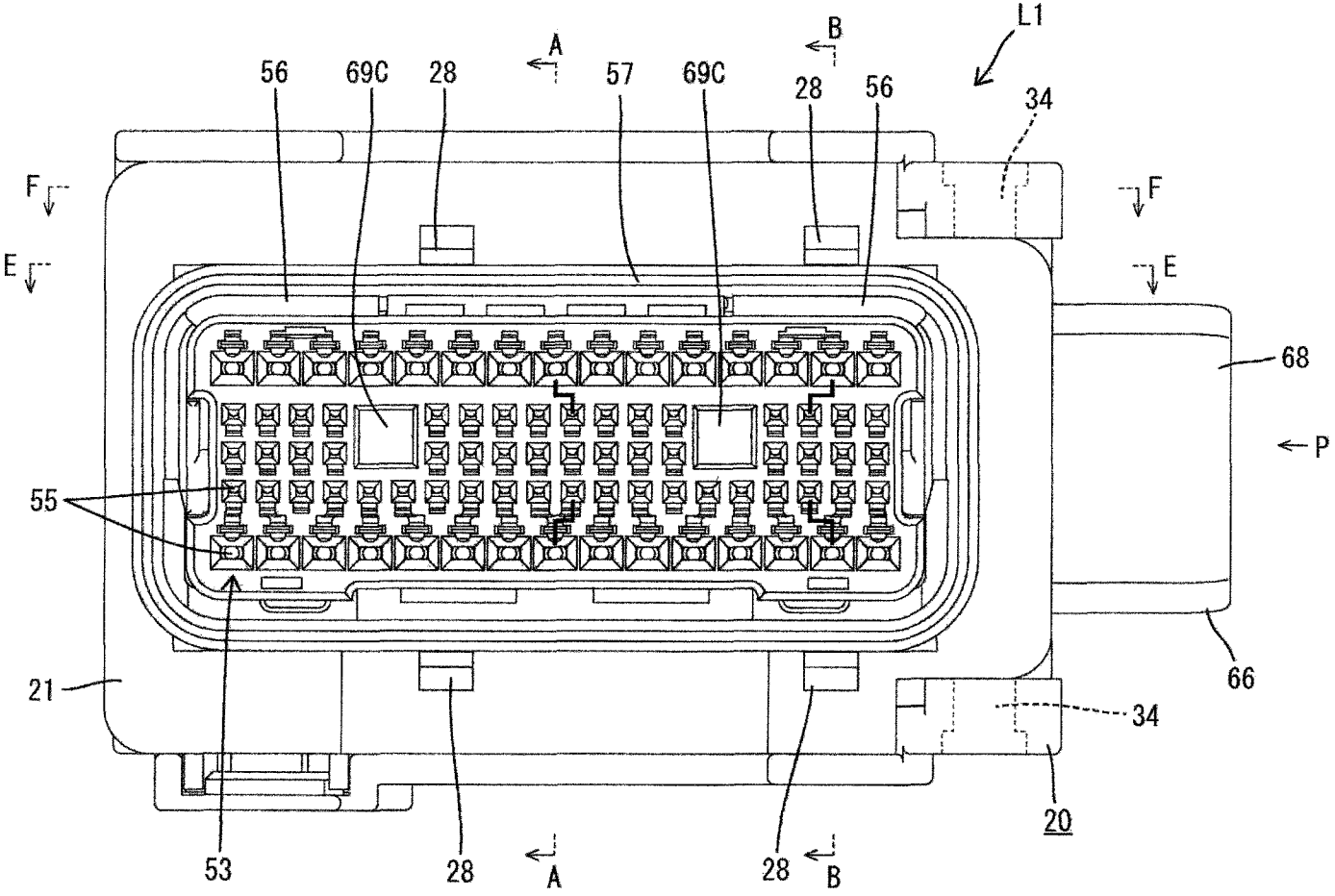
FIG. 11 is a front view of the first lever-side connector when the lever is at the connection end position.
Figure 25:
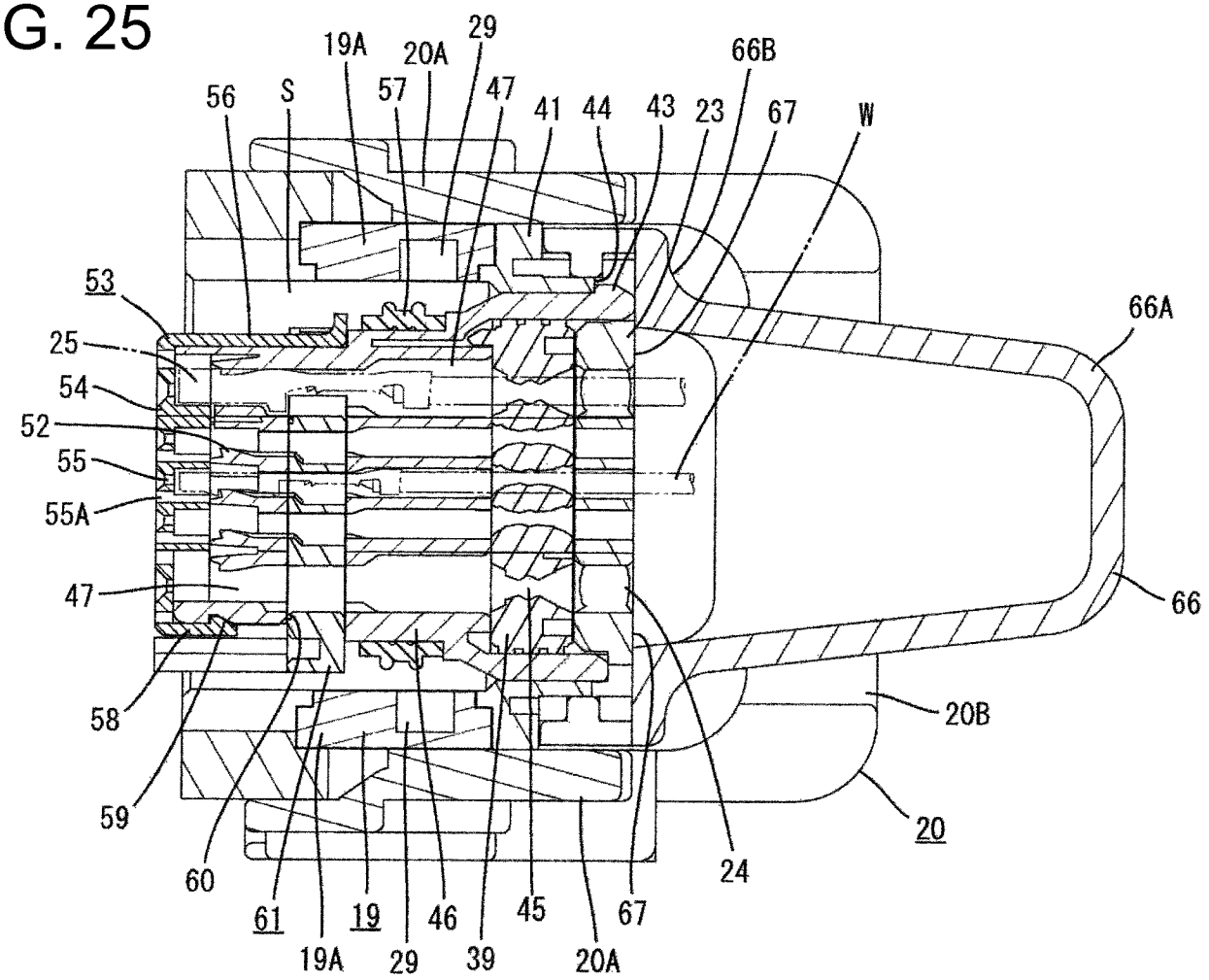
FIG. 25 is a rear view of a front mask.

As shown in FIG. 12, a front mask 53 is mounted on the front end surface of the terminal accommodating portion 46. The front mask 53 includes a part that communicates with the cavities 47 and accommodates front ends of the female terminal fittings 25 so that front ends of the female terminal fittings 25 contact stop walls 54 of the front mask 53. Each front stop wall 54 has a tab insertion hole 55 that receives the male terminal fitting 6 and a jig insertion hole 55A is formed adjacent to and below the tab insertion hole 55. Further, as shown in FIGS. 11 and 25, the front mask 53 is formed with two escaping holes 69C for allowing the guide projection shafts 4 of the first fixed connector F1 to escape. Further, as shown in FIG. 25, left and right separate pressing pieces 56 extend toward a seal ring 57 on the upper edge of the surface of the front mask 53 facing the inner housing 22. The tips of the pressing pieces 56 rise up or out directly before the seal ring 57 to prevent the detachment of the seal ring 57. Left and right lock claws 58 are provided on a lower part of the seal ring 57. As shown in FIGS. 26 and 27, the lock claws 58 are locked in lock recesses 59 formed at corresponding positions of the lower surface of the terminal accommodating portion 46 of the inner housing 22 so that the front mask 53 can be mounted on the inner housing 22.

As shown in FIG. 12, a connection space S is between the outer peripheral surface of the terminal accommodating portion 46 and the inner surface of the outer housing 1 for receiving the first fixed connector F1. Further, the seal ring 57 is to be mounted on the outer peripheral surface of a back part of the terminal accommodating portion 46. The seal ring 57 can seal between the inner surface of the receptacle 2 of the first fixed connector F1 and the first lever-side connector L1.

Figure 24:
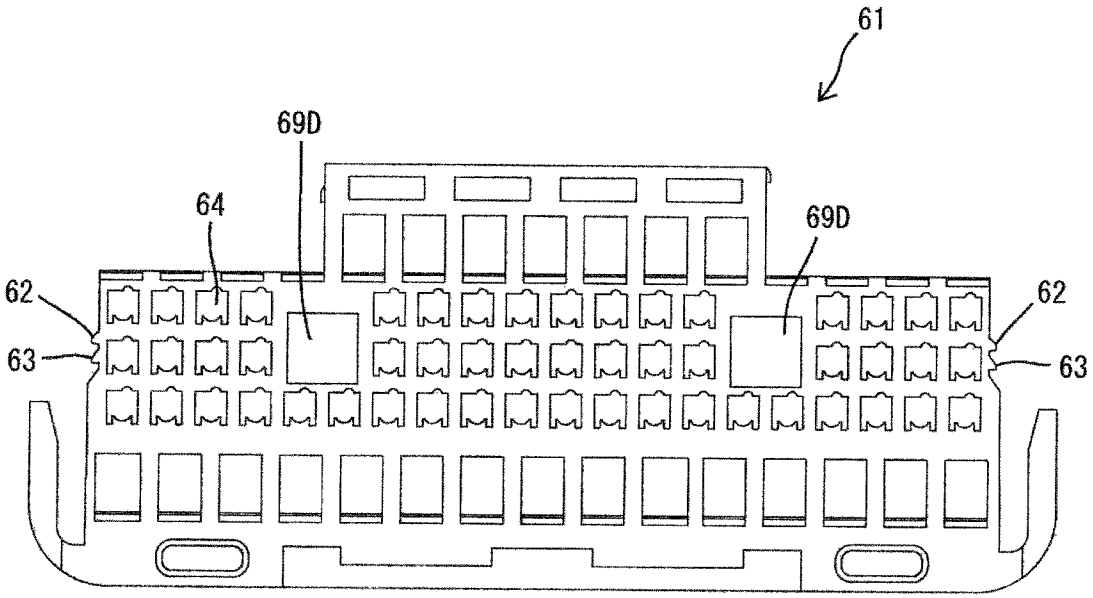
FIG. 24 is a front view of a retainer.

A retainer insertion hole 60 is formed in the side surface of the terminal accommodating portion 46 of the inner housing 22 and a retainer 61 is movably mounted into the retainer insertion hole 60 (see FIG. 24). The retainer 61 is a substantially flat plate and has locking holes 64 corresponding to the respective cavities 47 and two escaping holes 69D for allowing the guide projection shafts 4 of the first fixed-side connector F1 to escape. A first locking claw 62 and a second locking claw 63 project on each opposite side edge of the retainer 61 in a longitudinal direction while being arranged substantially side by side in an inserting direction of the retainer 61. Although not shown in detail, the locking claws 62, 63 are engaged successively releasably with lock receiving portions formed in the retainer insertion hole 60 to hold the retainer 61 at a partial locking position (FIG. 26) and a full locking position (FIG. 27) with respect to the inner housing 22. When the retainer 61 is at the partial locking position, the female terminal fittings 25 are freely insertable into and withdrawable from the respective cavities 47. When the retainer 61 is at the full locking position, the female terminal fittings 25 are locked by the retainer 61 as well as by the locking lances 52 to be retained doubly.

The wire cover 66 corrects a drawing direction of the wires W drawn out from the first lever connector L1. As shown in FIG. 12, the wire cover 66 is mounted to cover the wire drawing surface of the outer housing 21 (rear surface of the back wall 23) and the lever 20 is mounted to straddle the wire cover 66. The wire 66 has a wire drawing opening 68 that opens substantially normal to the wire draw-out direction of the wires from the housing. In this embodiment, the wire drawing opening 68 is set to be open out in the arrangement direction of the first and second fixed connectors F1, F2.

(Second Lever Connect L2)

Constituent members of the second lever-side connector L2 are basically similar to or the same as those of the first lever connector L1. Thus, no repeated description is given. The main differences are that the second lever connector L2 includes no slider, an operating direction of the lever 70 is substantially perpendicular to that of the first lever connector L1 and an opening direction of a wire drawing opening 72 of a wire cover 71 is substantially opposite to that of the first lever connector L1. Configurations relating to these differences are described below.

Figure 33:
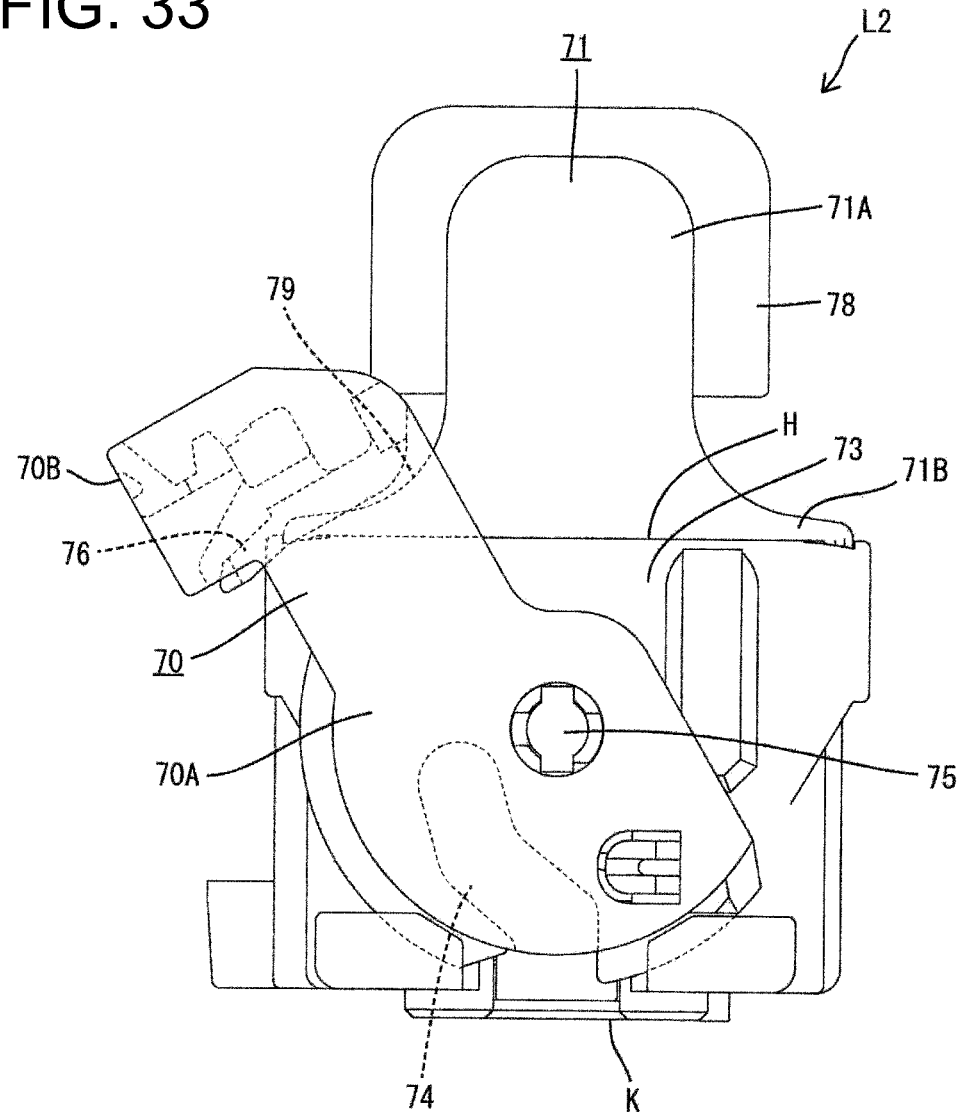
FIG. 33 is a side view when the lever is at an initial position.
Figure 34:
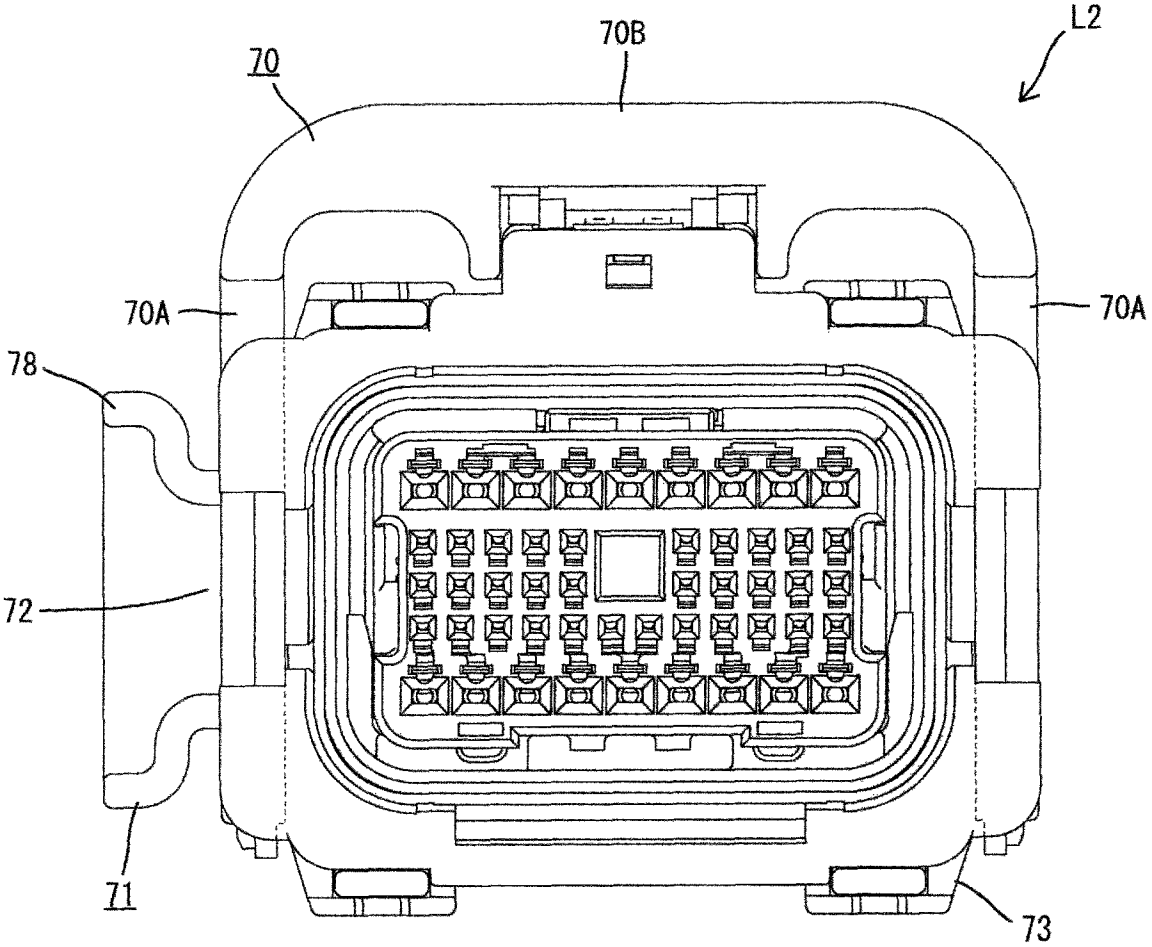
FIG. 34 is a front view when the lever is at the connection end position.

The lever 70 of the second lever-side connector L2 is mounted to straddle an outer housing 73 of the second lever connector L2 between opposite short side surfaces adjacent to a connection surface K and a wire drawing surface H, as shown in FIG. 33. A rotating direction of the lever 70 is perpendicular to the plane of FIG. 1 and along the opposite surfaces of the second fixed connector F2 where the cam followers 18 are provided. Thus, the rotating direction of the lever 70 of the second lever connector L2 particularly is substantially perpendicular to the rotating direction of the lever 20 of the first lever connector L1.

Figure 35:
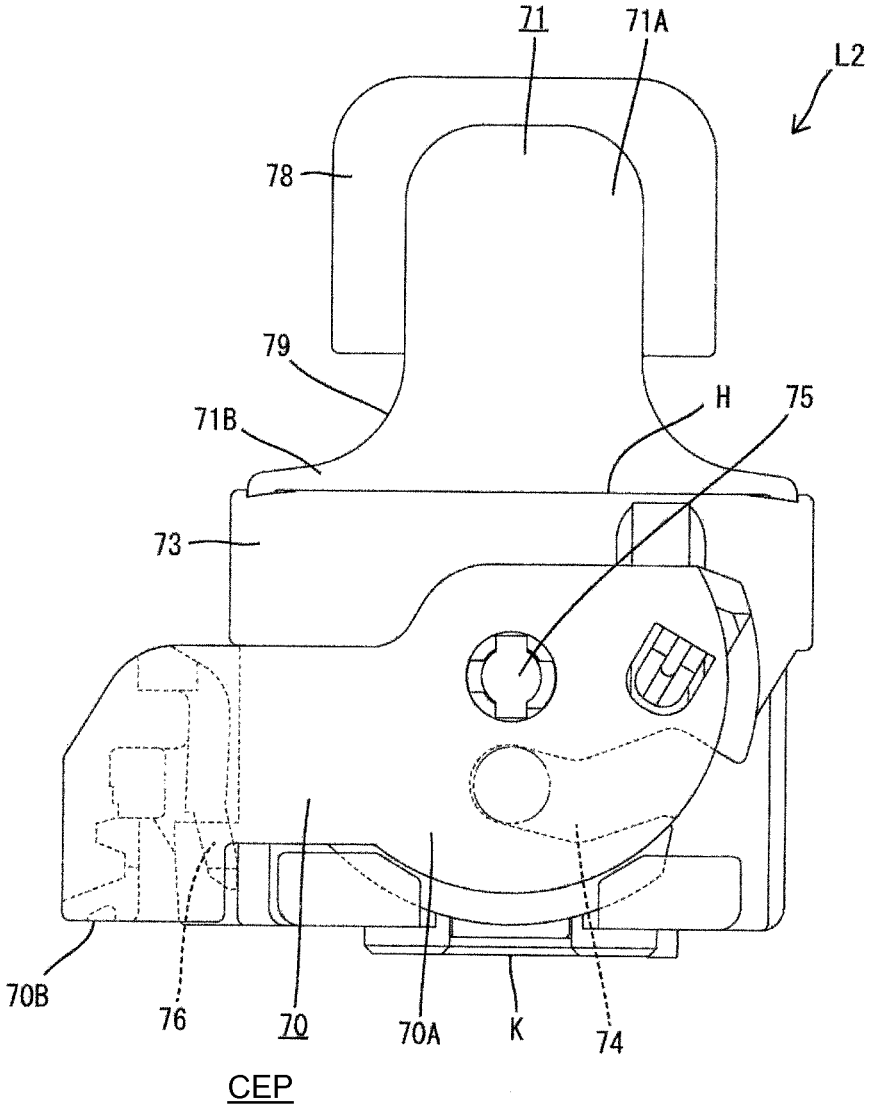
FIG. 35 is a side view when the lever is at the connection end position.

Inner surfaces of the lever plates 70A of the lever 70 are recessed to form cam grooves 74, as shown in broken line in FIGS. 33 and 35. The cam grooves 74 are engaged with the corresponding cam followers 18 of the second fixed-side connector F2 by the rotation of the lever 70 and guides the connectors F2, L2 to a connected state by a force multiplying action.

The lever 70 of the second lever connector L2 is also rotatable between an initial position (FIG. 33) and a connection end position (FIG. 35). Note that a mechanism for holding the lever 70 at the initial position is provided near a rotary shaft 75 of each of the lever plates 70A of the lever 70. The mechanism for holding at the initial position is known, and a detailed structure is not shown. Briefly, the lever plates 70A are provided with resiliently deformable hook-shaped partial holding means, which are configured to be engaged with the outer housing 73 to hold the lever 70 at the initial position, but automatically release a temporarily held state at the initial position by contacting a tip part of the second fixed connector F2 inserted into the second lever connector L2 when the second fixed-side connector F2 is fit lightly. A deflectable lock arm 76 is formed in the center of the operating portion 70B of the lever 70 and engages a receiving portion 77 (see FIG. 1) on a lower part of a side surface of the outer housing 73 for holding at the connection end position.

The wire cover 71 of the second lever connector L2 is to be mounted to cover a wire drawing surface of the outer housing 73 of the second lever connector L2. In this embodiment, the wire drawing opening 72 of the wire cover 71 of the second lever connector L2 is open out in the arrangement direction of the first and second fixed-side connectors F1, F2, i.e. in a direction substantially opposite to the opening direction of the first lever connector L1. Further, the wire drawing opening 72 of the wire cover 71 is widened to form a tape winding portion 78 (see FIG. 1).

The lever 20 of the first lever-side connector L1 is mounted to straddle the wire cover 66 mounted on the connector L1 as shown in FIG. 1, but the wire cover 71 of the second lever-side connector L2 is not mounted in such a manner. In other words, the operating direction of the lever 20 is along the drawing direction of the wires W from the wire cover 66 in the first lever connector L1, but the operating direction of the lever 70 and the drawing direction of the wires W are substantially perpendicular to each other in the second lever connector L2. Thus, when the lever 70 is at the initial position shown in FIG. 33 close to the wire cover 71, it may interfere with the wire cover 71. However, the wire cover 71 is formed with a constricted portion 79 along a longitudinal direction of a correcting portion 71A, as shown in FIGS. 33 and 35.

The wire cover 71 of the second lever connector L2 includes a base 71B for mounting on the outer housing 73 and the hollow correcting portion 71A unitarily projecting from the base 71B, extending substantially parallel to a direction of a rotation axis of the lever 70 and configured to correct the drawing direction of the wires W.

As shown in FIGS. 33 and 35, the correcting portion 71A rises substantially straight near the center while opposite sides of a base form curved surfaces of the constricted portion 79. Contrary to this, as shown in FIG. 27, a correcting portion 66A is formed to start rising at a position near a side edge of a base 66B and, then to narrow gradually toward a projecting end in the wire cover 66 of the first lever connector L1. In this way, in contrast to the first lever connector L1, the wire cover 71 of the second lever connector L2 is formed so that the correcting portion 71A rises at once via the constricted portion 79 from side edges of the base 71B an inner space of the wire cover 71 is narrowed in an intermediate position. This causes the wires W in the wire cover 71 to be collected and accommodated in an upper space in the wire cover 71. This prevents the wires W in the wire drawing opening 72 from being loosened downward so that a tape winding operation can be performed smoothly on the tape winding portion 78. Further, the formation of the wire cover 71 with the constricted portion 79 contributes to avoiding interference with the operating portion 70B when the lever 70 is at the initial position.

The second lever connector L2 is connected lightly to the second fixed connector F2 along a direction CD shown in FIG. 1 in a state where the lever 70 is at the initial position shown in FIG. 33. Then, the cam followers 18 of the second fixed connector F2 enter the cam grooves 74 of the lever 70 of the second lever connector L2. The lever 70 then is rotated in a counterclockwise direction shown in FIGS. 33 and 36, so that the cam followers 18 displace along the cam grooves 74 and the connection proceeds by a force multiplying action. The second fixed connector F2 and the second lever connector L2 reach a properly connected state when the lever 70 reaches the connection end position shown in FIGS. 2 and 35 and is held thereat.

The first lever connector L1 is held at the initial position shown in FIG. 1 prior to connecting the first lever connector L1 to the first fixed connector F1. At this time, the locking claws 30 are locked in the first locking recesses 31 to hold the slider 19 at the movement start position shown in FIG. 28. The first lever connector L1 then is connected lightly to the first fixed connector F1 along a direction CD shown in FIG. 1 so that the cam followers 17 of the first fixed connector F1 enter the corresponding cam grooves 29. The lever 20 then is rotated counterclockwise, as shown in FIG. 28. Thus, the locking state of the locking claws 30 and the first locking recesses 31 is released and the slider 19 is displaced toward the back in the slider accommodation chamber 26 as the lever 20 rotates. Accordingly, the cam followers 17 are displaced along the corresponding cam grooves 29 with a force multiplying action that connects the first fixed connector F1 and the first lever connector L1. The locking claws 30 lock into the second locking recesses 32 when the lever 20 reaches the connection end position shown in FIG. 29 and the slider 19 reaches the movement end position, thereby holding the first fixed connector F1 and the first lever connector L1 in a properly connected state.

The surfaces of the laterally adjacent first and second fixed connectors F1, F2 that have the cam followers 17, 18 are substantially perpendicular to each other. Additionally, the rotating directions of the levers 20, 70 of the first and second lever connectors L1, L2 are substantially perpendicular to each other. Thus, the levers 20, 70 will not interfere with each and a distance between the fixed connectors F1, F2 can be shortened. Therefore, the fixed connector unit U can be made smaller than the prior art connector with parallel levers.

The slider 19 mounted into the first lever connector L1 projects out from the outer housing 21 at the start position in the arrangement direction of the fixed connectors F1, F2. This also contributes to the shortening of the distance between the both fixed connectors F1, F2.

The wires W are drawn out at opposite outer sides in the arrangement direction of the fixed connectors F1, F2 in the lever connectors L1, L2, thereby further shortening the distance between the fixed connectors F1, F2.

A space where the lever 70 is rotated is different from a space where the wire cover 71 projects. Thus, the length of the lever 70 can be set independently of the projecting height of the wire cover 71, thereby enabling the miniaturization of the lever 70.

The wire cover 71 of the second lever connector L2 has the correcting portion 71A that rises from the base 71B via the constricted portion 79 to narrow the inner space in the central part of the wire cover 71. Thus, the wires W are collected in the space above the constricted portion 79 and easily can be taped together with the wire cover 71.

The operating portion 70B of the lever 70 is located along an extending direction of the constricted portion 79 and is near the constricted portion 79 when the lever 70 is at the initial position. Thus, the lever 70 does not interfere with the wire cover 71.

The positioning holes 51 of the one-piece rubber plug 39 have the narrowed portions 51A at axial intermediate positions. Thus, material around the narrowed portions 51A displaces toward the adjacent wire insertion holes 45 when the positioning pins 48 of the inner housing 22 are press-fit so that press-contact forces applied to the insulation coatings of the wires W is increased and sealing is improved.

Axial positions of the narrowed portions 51A in the positioning holes 51 align with the inner lips 50 to further improve sealing with the wire insulation coating.

The positioning holes 51 are arranged at diagonal positions around the respective wire insertion holes 45. Thus sealing forces for the wires W are circumferentially uniform while narrowing intervals between the wire insertion holes 45 as much as possible.

The protecting edges 38 of the first lever connector L1 partly surround the end of the slider 19 projecting from the outer housing 21 at the initial position and are close to the rotary shafts 34. Thus, the slider 19 is not likely to be pushed inadvertently.

The lever 20 has two lever plates 20A for holding the slider 19 therebetween and the rear edges of the lever plates 20A define the protecting edges 38. Thus, external matter is likely to contact the protecting edges 38 instead of with the slider 19, and the slider 19 is not likely to be pushed inadvertently.

The invention is not limited to the above described embodiment. For example, the following embodiments are also included in the scope of the invention.

The slider 19 and the lever 20 are mounted on the first lever-side connector L1 in the above embodiment. However, only one of them may be mounted. Conversely, both the lever 70 and a slider may be mounted on the second lever-side connector L2.

The housings of the first and second lever connectors L1, L2 have outer and inner members, but may be a single member. In such a case, the back wall 23 of the housing may be formed separately, and the separately formed back wall 23 may be formed with positioning pins that are inserted into the positioning holes 51 formed in the front and rear surfaces of the one-piece rubber plug 39.

Positioning holes 51 are formed in front and rear surfaces of the one-piece rubber plug 39 in the above embodiment, but they may be in only the surface facing the inner housing 22.

The retainer 61 is held at the partial locking position and the full locking position in the above embodiment, but the partial locking position may not be provided.

The front mask 53 is mounted on the inner housing 22 from front in the above embodiment, but it may be mounted in a direction at an angle to the connecting direction.

The retainer 61 is mounted in the deflecting direction of the lock claws 58 in the above embodiment, but may be mounted at an angle to the deflecting direction.

What is claimed is:

1. A connector with a force multiplying mechanism, comprising:

at least first and second fixed connectors arranged substantially side by side and first and second cam followers provided on surfaces of the respective first and second fixed connectors; and at least first and second lever connectors individually connectable to the respective fixed connectors and provided respectively with first and second displaceable levers, the lever connectors being connectable to the corresponding fixed connector by a force multiplying action produced by displacing the respective lever while the respective lever engages the respective cam follower;

wherein the surface of the first fixed connector that has the first cam follower is aligned substantially perpendicular to the surface of the second fixed connector that has the second cam follower.

2. The connector of claim 1, further comprising a slider accommodated movably along an arrangement direction of the fixed connectors in at least one of the lever connectors, the slider having a cam groove that engages the cam follower to produce the force multiplying action by displacing the lever while the cam groove and the cam follower are engaged.

3. The connector of claim 2, wherein the slider is movable between a start position where the cam follower is received and an end position where the connection of the fixed-side connector and the lever-side connector is finished, the slider projecting out from the lever connector in the arrangement direction when at the start position.

4. The connector of claim 1, wherein wire drawing directions in the respective lever-side connectors are substantially opposite outward directions with respect to the arrangement direction.

5. The connector of claim 1, wherein the lever connector comprises a housing connectable to the fixed-side connector, the lever being mounted displaceably to extend between opposite side surfaces of the housing; and a wire cover projecting out from the housing while at least partly covering a wire drawing surface and configured to correct a wiring direction of wires drawn out from the wire drawing surface; the lever being mounted to side surfaces of the housing between a connection surface and the wire drawing surface and displaceable substantially along a connecting direction between the connection surface and the wire drawing surface.

6. The connector of claim 5, wherein the wire cover includes a base that is mountable on the housing and open toward the wire drawing surface, and a correcting portion that rises from the peripheral edge of the base via a constricted portion to narrow an inner space from the base.

7. The connector of claim 6, wherein the correcting portion of the wire cover extends and projects from the base in a direction substantially parallel to a rotation axis of the lever via the constricted portion; and the lever comprises two lever plates mounted on the housing and an operating portion coupling the lever plates and positioned at an initial position before connection to the mating connector, and the operating portion of the lever is along an extending direction of the constricted portion near the constricted portion at the initial position.

8. The connector of claim 1, wherein at least one of fixed connectors and lever connectors is provided with a one-piece resilient plug with wire insertion holes and configured to collectively seal wires drawn out from a rear surface of a housing by inserting the wires respectively into the wire insertion holes, the one-piece resilient plug being sandwiched between two wall surfaces from front and rear in an inserting direction of the wire(s); and at least one positioning pin projecting substantially parallel with axial directions of the wire insertion holes from one of the wall surfaces toward the one-piece resilient plug and inserted and press-fit into at least one positioning hole arranged near the wire insertion hole(s).

9. The connector of claim 8, wherein the positioning hole has at least one narrowed portion at an axial intermediate position.

10. The connector of claim 9, wherein at least one inner lip to be held in close contact with an insulation coating of the wire is formed on the inner peripheral surface of the wire insertion hole, and an axial position of the narrowed portion in the positioning hole is aligned with a peak of the inner lip.

11. The connector of claim 8, wherein plural positioning holes are arranged at substantially diagonally symmetric positions with respect to the wire insertion hole.

12. A connector with a force multiplying mechanism, comprising:

at least first and second fixed connectors arranged substantially side by side and first and second cam followers provided on surfaces of the respective first and second fixed connectors;

at least first and second lever connectors individually connectable to the respective fixed connectors and provided respectively with first and second displaceable levers, the lever connectors being connectable to the corresponding fixed connector by a force multiplying action produced by displacing the respective lever while the respective lever engages the respective cam follower, at least one of the lever connectors having a housing; and a slider mounted through a side surface of the housing and being slidable in a direction intersecting a connecting direction and formed with at least one cam groove engageable with at least one cam follower provided on a mating one of the fixed connectors; and the lever including an operating portion on one end and being mounted displaceably on the housing while being interlockingly coupled to the slider;

the slider being movable with respect to the housing between a start position where the cam follower is received into the cam groove while the slider projects back in a mounting direction thereof and an end position reached by inserting the slider deeper into the housing from the start position to properly connect the connector with the mating connector;

one of the slider and the lever including a lock that holds the slider at the start position by being locked to the housing, the lock being releasable from the housing by displacing the lever; and the lever including a protecting edge disposed for impeding contact with a projecting end part of the slider when the slider is at the start position.

13. The connector of claim 12, wherein the lever is mounted rotatably on the housing via at least one rotary shaft, and wherein a distance from the rotary shaft (34) to the protecting edge is shorter than a distance from the rotary shaft to the operating portion.

14. The connector of claim 13, wherein the lever comprises two lever plates and the operating portion coupling the lever plates and mounted to straddle opposite side surfaces adjacent to a surface, through which the slider is mounted, and substantially facing each other; and the protecting edge is formed on each of the lever plates to sandwich the projecting end part of the slider.

* * * * *